US009573721B2

(12) United States Patent
Cheeser et al.

(10) Patent No.: US 9,573,721 B2
(45) Date of Patent: Feb. 21, 2017

(54) PACKAGING SYSTEM

(71) Applicant: PepsiCo, Inc., Purchase, NY (US)

(72) Inventors: Max W Cheeser, Plano, TX (US); David A Hampton, Plano, TX (US); David G Lothian, Plano, TX (US); John Stanley Phillips, Plano, TX (US); Andrew Smith, Plano, TX (US); Harold Smith, Scottsdale, AZ (US)

(73) Assignee: PepsiCo, Inc., Purchase, NY (US)

( * ) Notice: Subject to any disclaimer, the term of this patent is extended or adjusted under 35 U.S.C. 154(b) by 14 days.

(21) Appl. No.: 14/461,065

(22) Filed: Aug. 15, 2014

(65) Prior Publication Data

US 2016/0046404 A1 Feb. 18, 2016

(51) Int. Cl.

| | |
|---|---|
| ***B65D 5/49*** | (2006.01) |
| ***B65D 5/44*** | (2006.01) |
| ***B65D 5/50*** | (2006.01) |
| ***B65D 5/02*** | (2006.01) |
| ***B65D 5/42*** | (2006.01) |
| ***B65D 5/498*** | (2006.01) |

(52) U.S. Cl.

CPC ..... *B65D 5/48024* (2013.01); *B65D 5/0227* (2013.01); *B65D 5/4266* (2013.01); *B65D 5/445* (2013.01); *B65D 5/48028* (2013.01); *B65D 5/48046* (2013.01); *B65D 5/48048* (2013.01); *B65D 5/5028* (2013.01)

(58) Field of Classification Search

CPC .... B65D 5/48; B65D 5/48024; B65D 5/48048
USPC ..... 229/120.32, 120.19, 120.21, 120.28, 229/120.02, 120.29, 120.38, 120.26, 229/120.05, 120.27, 120.31, 120.36; 220/529

See application file for complete search history.

(56) References Cited

U.S. PATENT DOCUMENTS

| | | | | |
|---|---|---|---|---|
| 3,197,111 A * | 7/1965 | Kozlowski | ..... | B65D 5/48026 229/120.29 |
| 4,934,589 A * | 6/1990 | Stephenson | ..... | B65D 5/48 229/120.28 |
| 9,120,593 B2 * | 9/2015 | Mena | ..... | B65D 5/48024 |
| 2006/0124713 A1 * | 6/2006 | Bos | ..... | B65D 5/48038 229/120.36 |

* cited by examiner

*Primary Examiner* — Christopher Demeree
(74) *Attorney, Agent, or Firm* — Colin P. Cahoon; Shaukat A. Karjeker; Carstens & Cahoon, LLP

(57) ABSTRACT

A packaging system for a corrugated cardboard shipping container. The system uses two vertical compartmented inserts divided by a horizontal insert. The compartmented insert can be configured by a packer to consist of four to two rectangular compartments. The horizontal insert can be folded in half or have a quarter section folded away in order to accommodate a loading plan that requires items to protrude above the height of the bottom vertical compartmented insert. An optional diagonal divider and dunnage may be used prior to sealing the container.

14 Claims, 33 Drawing Sheets

PACKAGING SYSTEM

BACKGROUND OF THE INVENTION

Technical Field

The present invention relates to a packaging system and corrugated cardboard packaging box with inserts used for shipping goods. Specifically, the invention relates to a set of components used in a corrugated cardboard box that compartmentalize the box into weight bearing compartments, thus allowing for the simultaneous packaging within the box of items having disparate shapes, sizes, and density. This creates a unique ability to ship light and fragile products with heavy products.

Description of Related Art

Retail online purchasing by consumers has exploded over recent years. Consumer goods of all types can now be ordered online and shipped directly to the consumer. The means for shipping such product is typically a corrugated box in which the product ordered is placed, along with dunnage (such as filler paper, plastic bubble wrap, styrofoam pieces, etc.), which is used to protect the product from damage during shipping. Shipping product in this way, in a corrugated box with dunnage, is adequate for most packaging solutions. However, an emerging retail grocery market available through online ordering and delivery to the consumer presents challenges to this standard shipping method. Specifically, consumers have begun to order grocery items online through outlets such as Amazon's PrimePantry™ and Walmart.com.

The model of offering grocery items to a consumer through online sale and shipped delivery poses unique challenges and problems. Many grocery items don't combine well in a single box. Yet, the model for retail online grocery services requires that all items be shipped in as few boxes as possible in order to limit shipping cost. In fact, some models for online grocery shopping limit the consumer to the filling of a single box per order based on the weight and cubic size of the order. Consequently, any packaging used to support this model must provide protection for products of disparate shape, size, weight, and density, as is typical of a grocery order.

For example, a single order from a consumer may include canned goods, various boxes and bottles, various bagged goods such as bread products and flexible pillow bags with crushable contents such as potato chips. The problems faced in this situation can be understood when imaging a box filled with heavy canned goods combined with several pillow bags holding potato chips and tortilla chips. While packing this box, the best protection that can be provided under current practices is to place all the heavier items (the canned goods) at the bottom of the box and the lighter items (the pillow bags) at the top of the box. Some dunnage can be added to provide some extra protection. However, unless the box maintains the same orientation throughout the entire shipping process, the heavier items on the bottom of the box will at some point crush the pillow bags placed at the top of the box. This usually results in rupturing of the bags and crushing of the food product found within the pillow bags.

A prior art alternative to a corrugated box with dunnage involves a corrugated box with a modular product protection system comprising one or more vertical compartmented insert. This compartmented insert is illustrated in FIGS. 1A, 1B, 1C, 1D, 1E, and 1F. FIG. 1A shows one embodiment of a compartmented insert in a folded or flat configuration suitable for storage. The insert is typically made from corrugated cardboard. Shown in FIG. 1A is one side of the insert when in the folded configuration. Six panels 10, 12, 14, 16, 18, 20 of the insert can be seen. The top panels 10, 12, 14 are separated from the bottom panels 16, 18, 20 by a cut 62 through on side of the piece. Also shown are folding points 60.

The insert is deployed by first forming the flat insert shown in FIG. 1A into a two-tiered rectangular insert shown in FIG. 1B. The interior panels on the top of the insert 26, 32, 34, as well as an interior divider 22 can now be seen. Also shown is an interior flap 30 which attaches the interior divider 22 to one of the interior side panels 34.

Also shown in FIG. 1B is a folding point 64 about which the upper portion of the now expanded insert comprising the upper panels 10, 12, 14 will be separated from the lower half of the insert comprising the lower panels 16, 18, 20 at the cut line 62. This process is shown in FIG. 1C wherein the upper portion of the insert comprising the upper panels 10, 12, 14 is being rotated away about the fold line 64 from the bottom half of the insert comprising the lower panels 16, 18, 20. Also revealed are additional internal panels 28, 36, 38 and an additional interior divider 24.

FIG. 1D shows the continuation of the action shown in FIG. 1C as the upper half of the compartmented insert is further rotated about the folding line 64 toward a final deployment. Interior panels 26, 28, 32, 34, 36, 38 are again visible along with two interior dividers 22, 24.

The final deployment of the vertical compartmented insert is illustrated in FIG. 1E. It can be seen that what was formerly an upper panel 14 is now in the same horizontal plane as a lower panel 20 and that these two panels 14, 20 abut. The deployed insert is now ready for placement in a box. Two additional panels 40, 42 are now also apparent from the interior of the compartmented insert. It can also be seen that the fold line 64 has now become a ridge 64 made up of one edge of a continuous piece of material consisting of two corrugated cardboard sheets. Further, it can be seen that two of the panels 36, 38 are now panels on an interior divider made up on one of the sheets of corrugated cardboard that forms the strong ridge 64 bisecting the center of the now fully deployed vertical compartmented insert. This deployed compartmented insert, as shown, has four compartments or cells, each cell defined by four interior panels/dividers.

This deployed compartmented insert is of such dimension as to nest in a companion corrugated box 190 such as the one illustrated in FIG. 1F. As is standard of a rectangular-shaped corrugated box 190, the box 190 illustrated in FIG. 1F is show in an open position with two wide flaps 194, and two long flaps 192, which can be used to seal the box 190. The compartmented insert is nested into the corrugated box 190 by placing it through the opening created by folding back the flaps 192, 194. The box 190 has now been transformed from one compartment to four compartments, thus reducing the direct interaction between products placed therein. Extra dunnage can be added as well to provide additional protection.

This prior art solution of a compartmented container using a compartmented insert nested in a corrugated box is an improvement over the prior art method of packaging a corrugated box with product protected by dunnage. However, the prior art usage of a compartmented insert does not provide the flexibility that an open box with dunnage provides in accommodating product of various sizes and shapes.

Consequently, a packaging system using a corrugate cardboard box as the outer shell is needed that provides both separation of product like a compartmented insert system provides as well as the ability to configure the interior of the box to accommodate products with varying shapes and sizes. This packaging solution should allow for quick and simple construction using common components. This packaging solution should provide protection for product within a corrugated cardboard box wherein the product consists of individual items of various sizes, shapes, and density.

SUMMARY OF THE INVENTION

In a preferred embodiment the invention consist of corrugated cardboard components placed inside a corrugated cardboard box, thereby dividing the interior of the box into various compartments. This preferred embodiment using the same components, allows for configurations within the box to accommodate a number of different products of different sizes, shapes, and density to all be isolated from each other. The design of the invention allows for the weight of individual items within a box to be contained within a single compartment and isolated from other products in the box.

In this preferred embodiment the first component inserted into the box is a vertical compartmented insert consisting, once it is unfolded and deployed, of four rectangular compartments. This vertical compartmented insert can be easily reconfigured to comprise three or two rectangular compartments by breaking interior dividers along perforation lines and folding the material back to the interior walls of the vertical compartmented insert. This feature of allowing from two to four rectangular compartments accommodates for different load plans or patterns in the interior of the box.

The next component placed in the box in the preferred embodiment is a horizontal divider. This horizontal divider can be placed in the box without any further manipulation, thereby dividing the box into an upper portion and a lower portion, with the horizontal divider becoming the top of the lower portion and the floor of the upper portion. However, the horizontal divider provides flexibility in address various product load configurations. This is accomplished by the functionality of folding the horizontal divider in half along a center score line or by folding back a quarter of the horizontal divider using a corrugated break line.

The next component added in a preferred embodiment is a second vertical compartmented insert. The second vertical compartmented insert is identical to the first vertical compartmented insert and maintains the same functionality. Therefore, in the upper portion of the box above the horizontal divider, the second vertical compartmented insert can be converted from its original configuration of four rectangular compartments to three or two rectangular compartments.

Once the system is configured to address the desired load pattern the corrugated box is sealed and shipped. Prior to sealing standard dunnage can also be added as needed.

In an alternative embodiment the rectangular compartments of the first and second vertical compartmented inserts can be divided diagonally by installing one or more diagonal inserts. Again, dunnage can be used to protect or isolate any particular item within the packaging system even when the diagonal inserts are used.

The invention therefore provides a packaging system using a corrugated cardboard box as the outer shell that provides both separation of product like a prior art compartmented insert system while also providing the ability to easily configure the interior of the box to accommodate products with varying shapes and sizes. The invention provides a packaging solution that allows for quick and simple construction using common components. The invention also provides a packaging solution that protects products within a corrugated cardboard box wherein the products consist of individual items of various sizes, shapes, and density. Using Applicants' invention the interior of a box can be easily and quickly configured to contain a number of different sized compartments or cells, each of which provides load bearing capabilities independent from other compartments in the box.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

While this invention has been particularly shown and described with reference to a preferred embodiment, it will be understood by those skilled in the art that various changes, in form and detail may be made therein without departing from the spirit and scope of the invention.

Figure 1A:
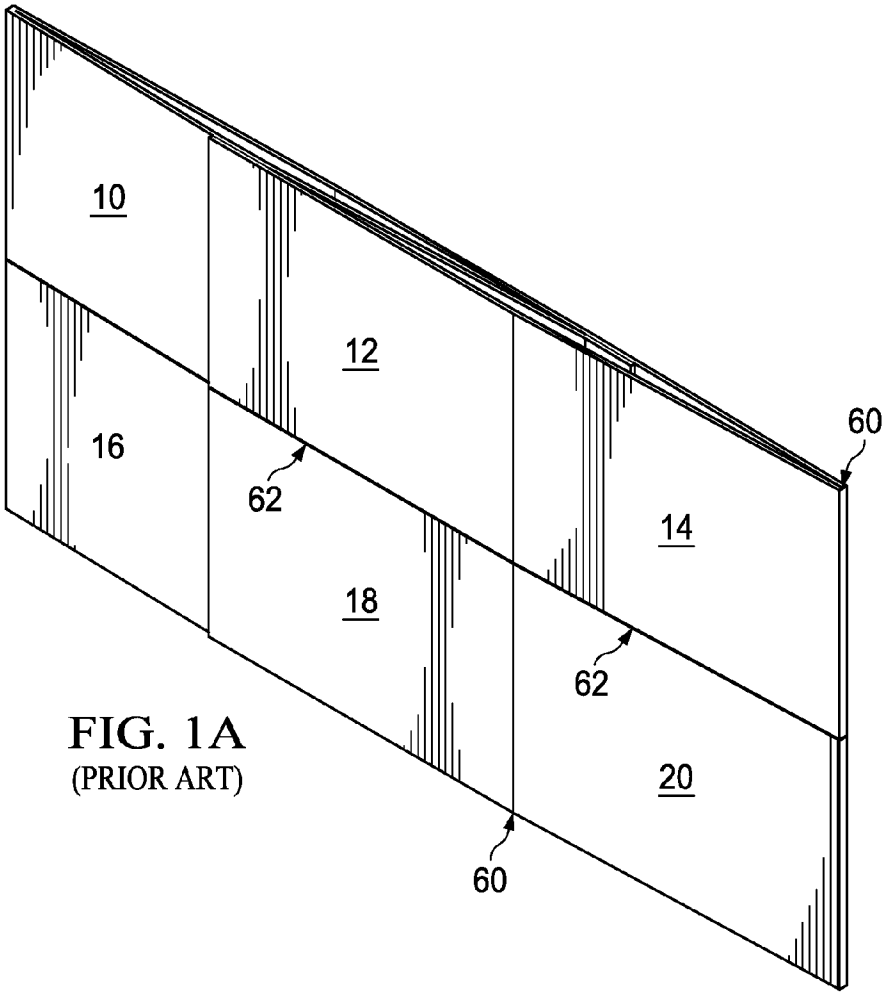
FIG. 1A (PRIOR ART)
FIGS. 1A, 1B, 1C, 1D, 1E, and 1F illustrate a prior art embodiment vertical compartmented insert in a corrugated cardboard box.
Figure 1B:
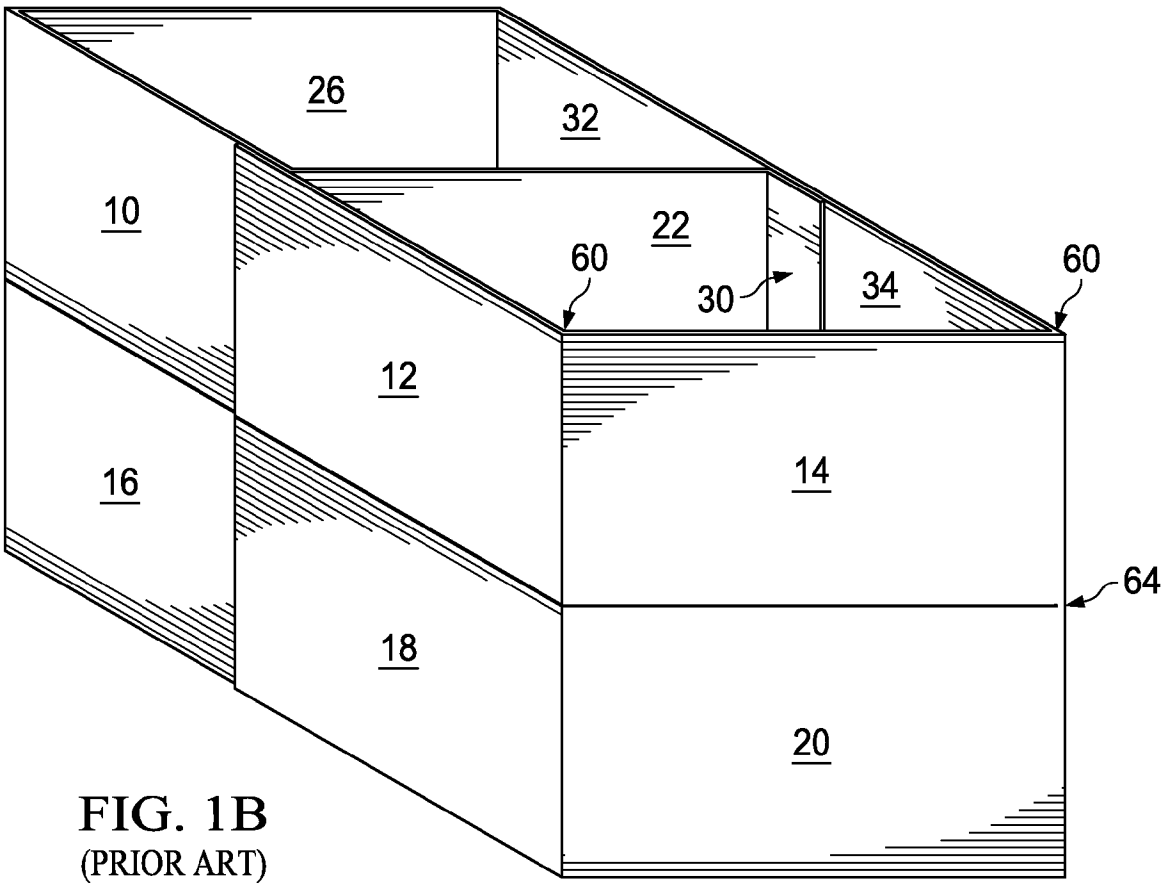
FIG. 1B (PRIOR ART)
Figure 2A:
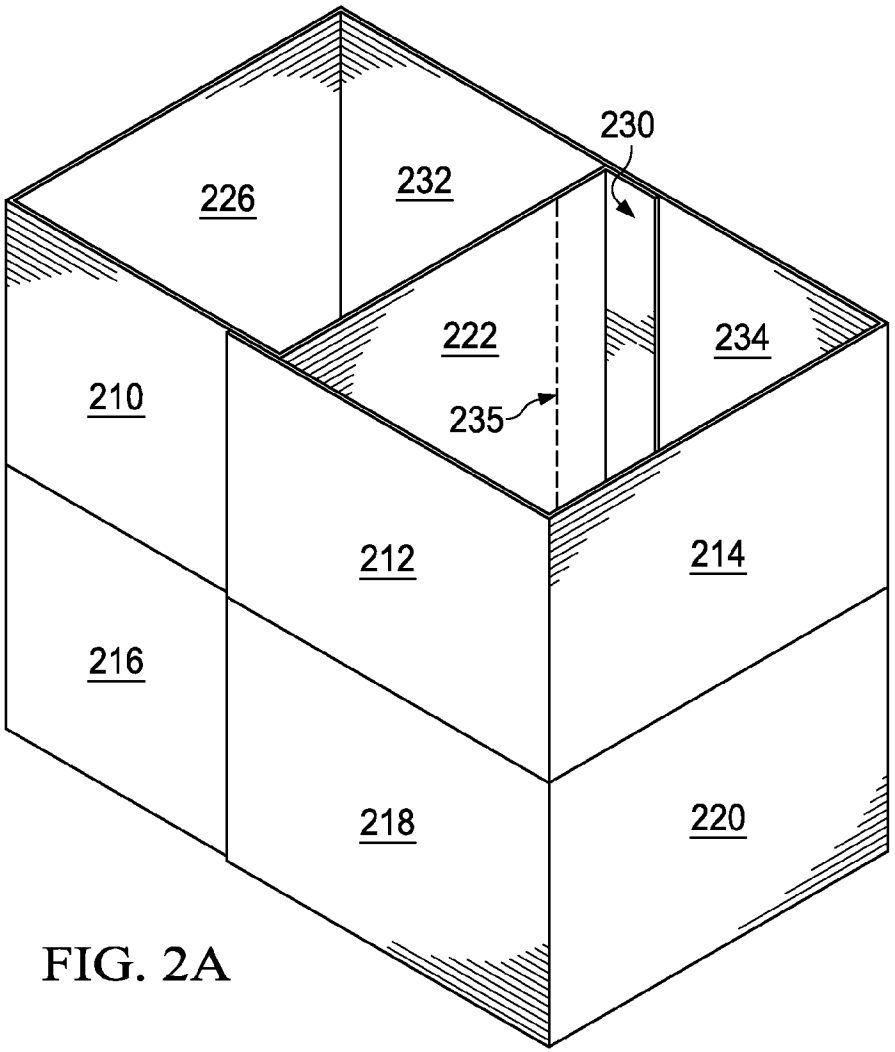
FIGS. 2A, 2B, 2C, 2D, 2E, 2F, and 2G illustrate one embodiment of a vertical compartmented insert of the present invention.

FIGS. 2A, 2B, 2C, 2D illustrate the deployment of the vertical compartmented insert of one embodiment of the present invention. FIG. 2A starts with an illustration showing the vertical compartmented insert in an expanded configuration, similar to the expanded configuration of a prior art vertical compartmented insert illustrated in FIG. 1B. As with the prior art vertical compartmented insert, the vertical compartmented insert of the present invention can be folded in an identical manner as shown in FIG. 1A for the prior art insert in order to accommodate storage in a flat configuration.

Returning to FIG. 2A, it can be seen that the components of the preferred vertical compartmented insert such as the upper panels 210, 212, 214, the lower panels 216, 218, 220, the interior panels 226, 232, 234, and the divider 222 with its connecting flap 230 are similar to the corresponding components in the prior art vertical compartmented insert. However, the present invention adds at least one perforation line 235 running vertically along at least one divider 222 in proximity to where the divider 222 attaches to the interior wall 234 of the insert along the flap 230. The horizontal distance from the perforation line 235 to the nearest interior wall 234 can vary from different embodiments of the invention. For example, the perforation line 235 can be as close as within a quarter of an inch from the interior wall 234 (can be at the wall 234) or can be more than several inches from the interior wall 234, depending on the size of the box and the dimensions of the vertical compartmented insert. The different functionality of the location of the perforation line 235 will be discussed below.

It should be understood that the dimensions of the components of the invention described herein can vary depending on the size of the corrugated cardboard box in which the components are to be used. By way of example only, in one embodiment the height of a given panel 216 is about 7.25 inches; the length of any longer panel 228 is about 10.25 inches, and the length of a shorter panel 238 of about 8.25 inches. This results in compartments or cells in the embodiment illustrated of approximately 10.25 inches by 8.25 inches horizontally and about 7.25 inches vertically. However, the vertical compartmented insert described herein can be designed for square compartments or rectangular compartments of different dimensions, again designed as necessary to fit the box in which the vertical compartmented insert will nest.

Figure 1C:
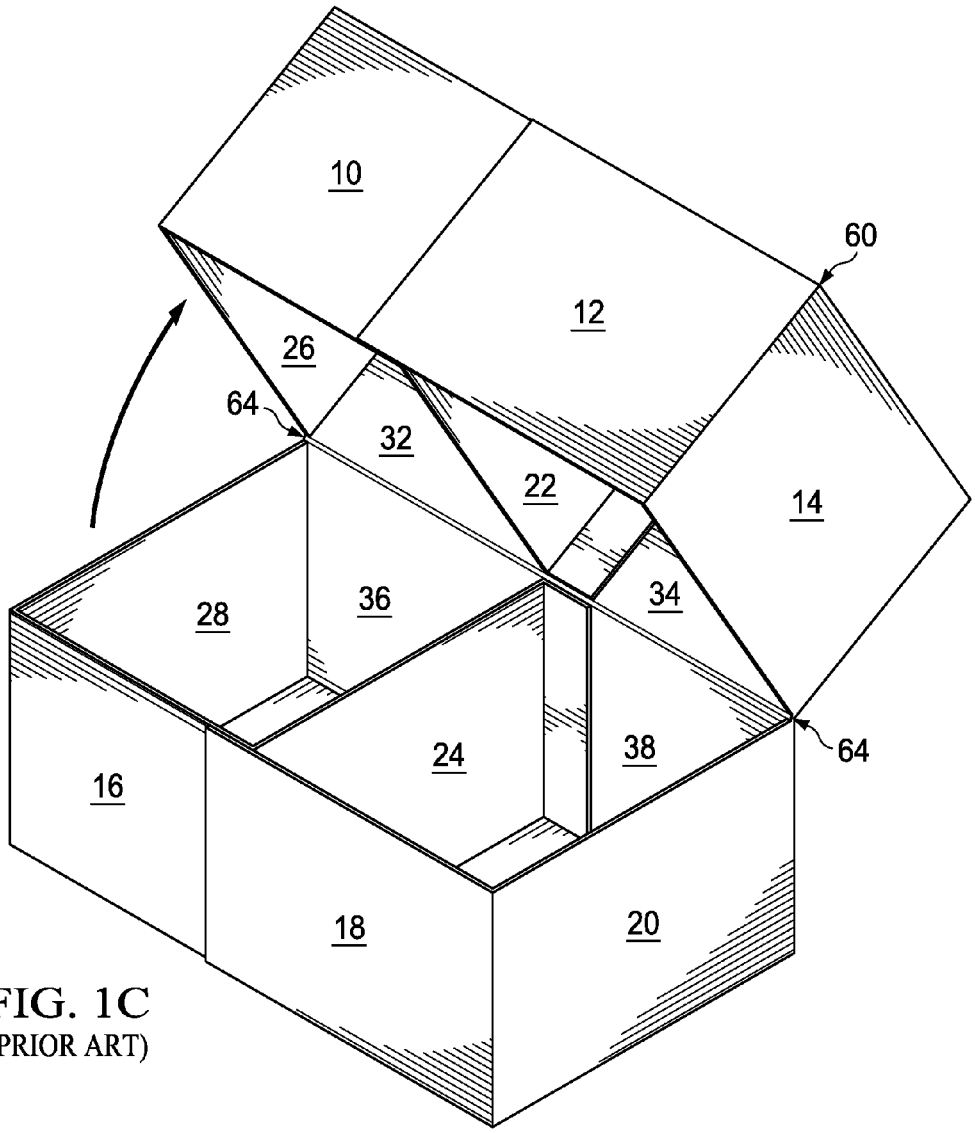
FIG. 1C (PRIOR ART)
Figure 1D:
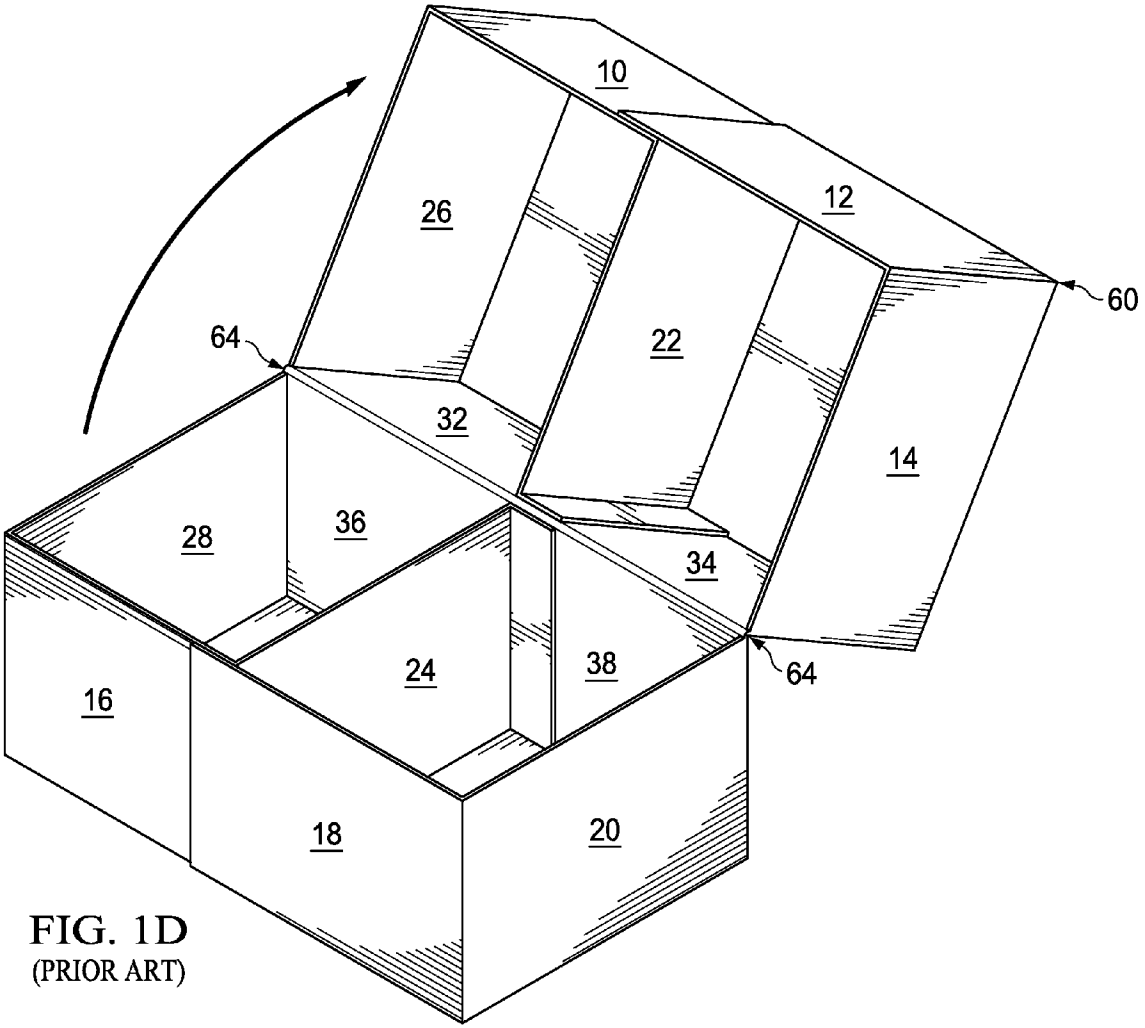
FIG. 1D (PRIOR ART)
Figure 1E:
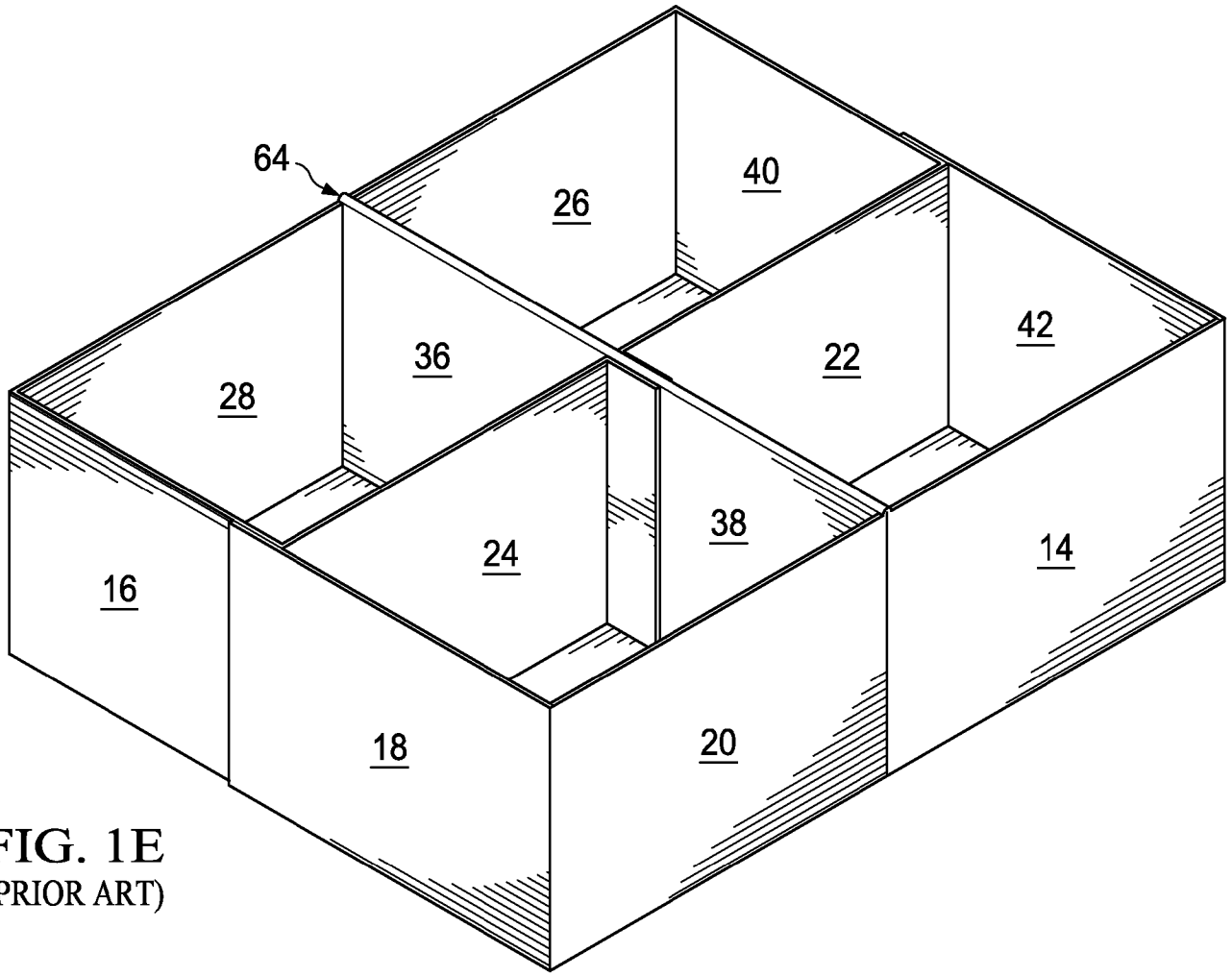
FIG. 1E (PRIOR ART)
Figure 1F:
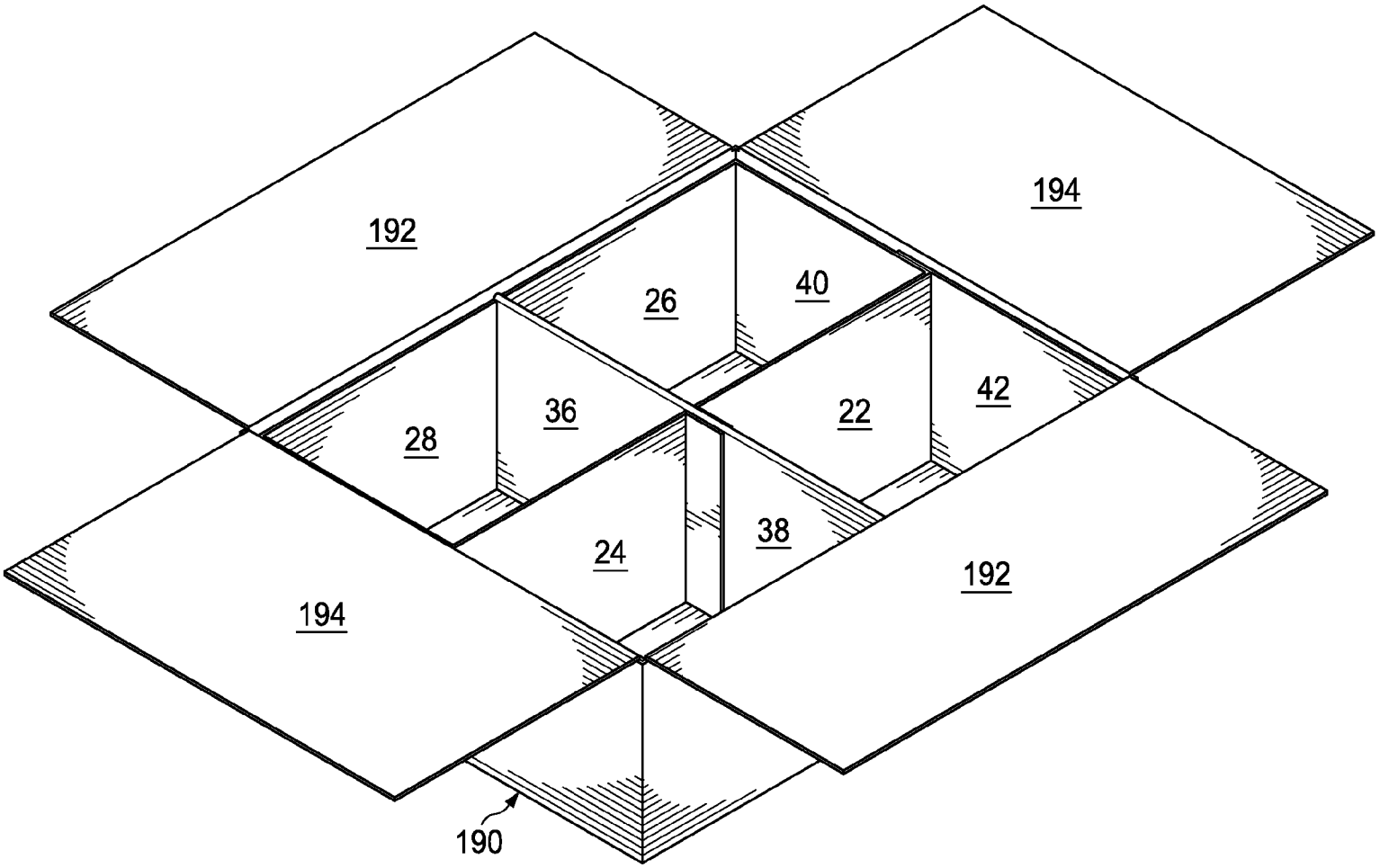
FIG. 1F (PRIOR ART)
Figure 2B:
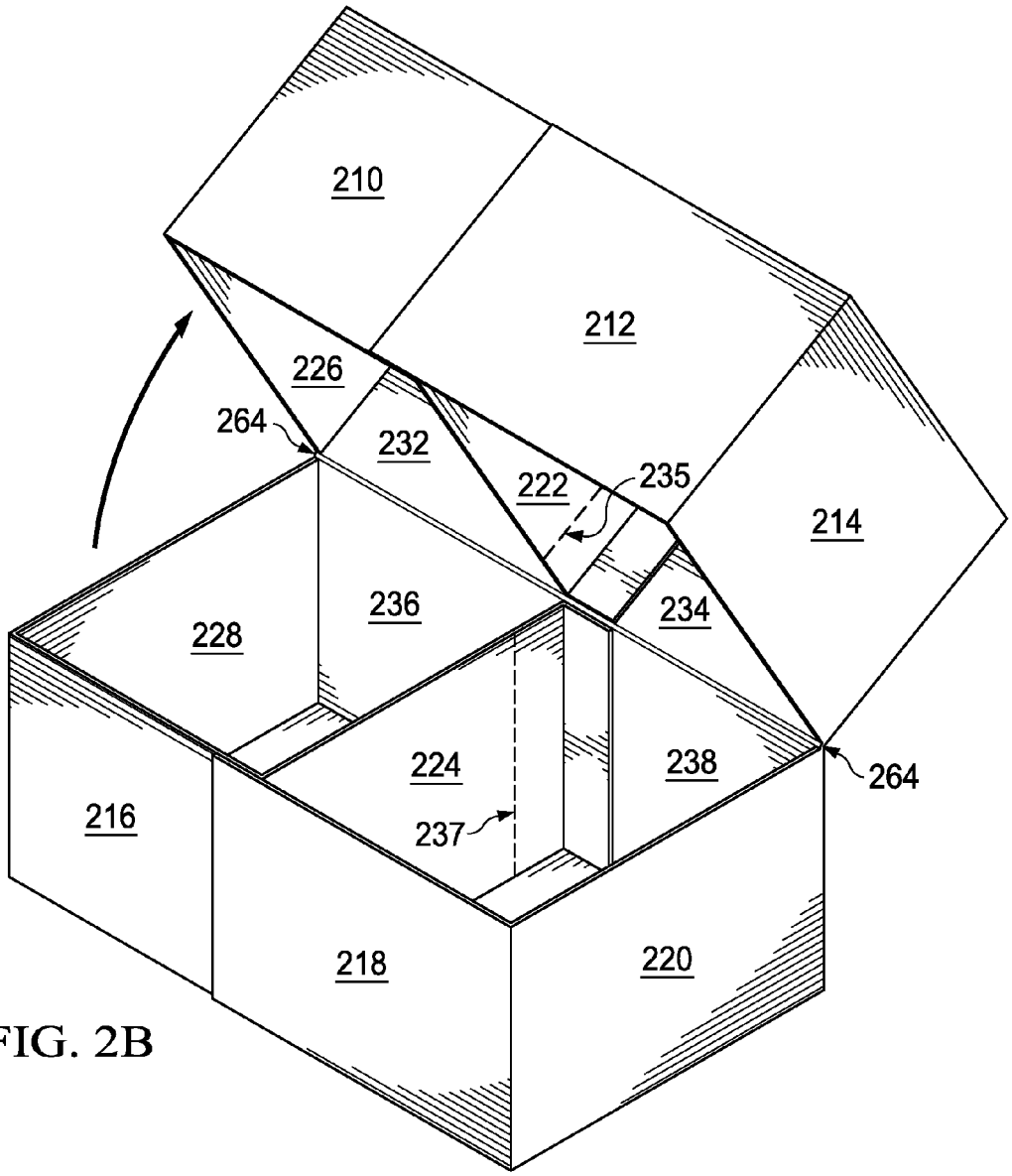
Figure 2C:
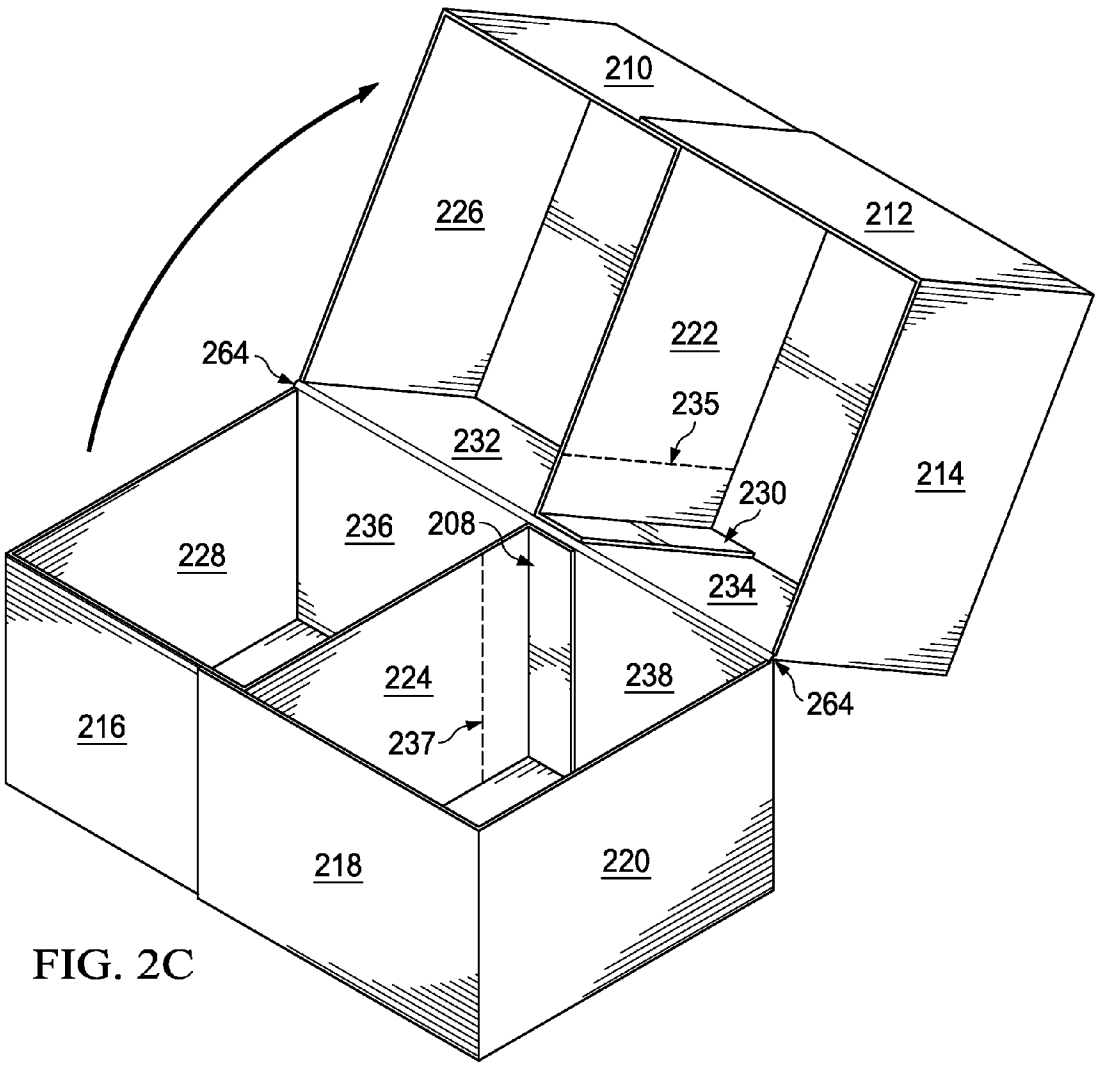

As with FIGS. 1C and 1D illustrating the continued deployment of a prior art compartmented insert, FIG. 2B and 2C show the continued deployment of the compartmented insert of the present invention. In particular, it can be seen in FIG. 2B that the deployment occurs by rotation about a fold 264, thereby allowing for the separation of the upper half of the expanded insert comprising the upper panels 210, 212, 214 from the lower half of the expanded compartment comprising the lower panels 216, 218, 220. Also shown is a second perforation line 237 oriented along a second divider 224. Interior panels 226, 228, 232, 234, 236, 238 as well as both dividers 222, 224 are also revealed in the view shown in FIG. 2B.

This motion is further illustrated in a more advanced position in FIG. 2C. Again, the upper portion of the expanded insert comprising the upper panels 210, 212, 214 continues to rotate towards an abutting position with the lower portion comprising the lower panels 216, 218, 220. The rotation occurs about the folding point 264, and the perforation lines 235, 237 are clearly shown. A lower flap 208 is also shown with a similar function of the upper flap 230, which is to provide an attachment point for the divider 224 to one of the interior panels 238.

Figure 2D:
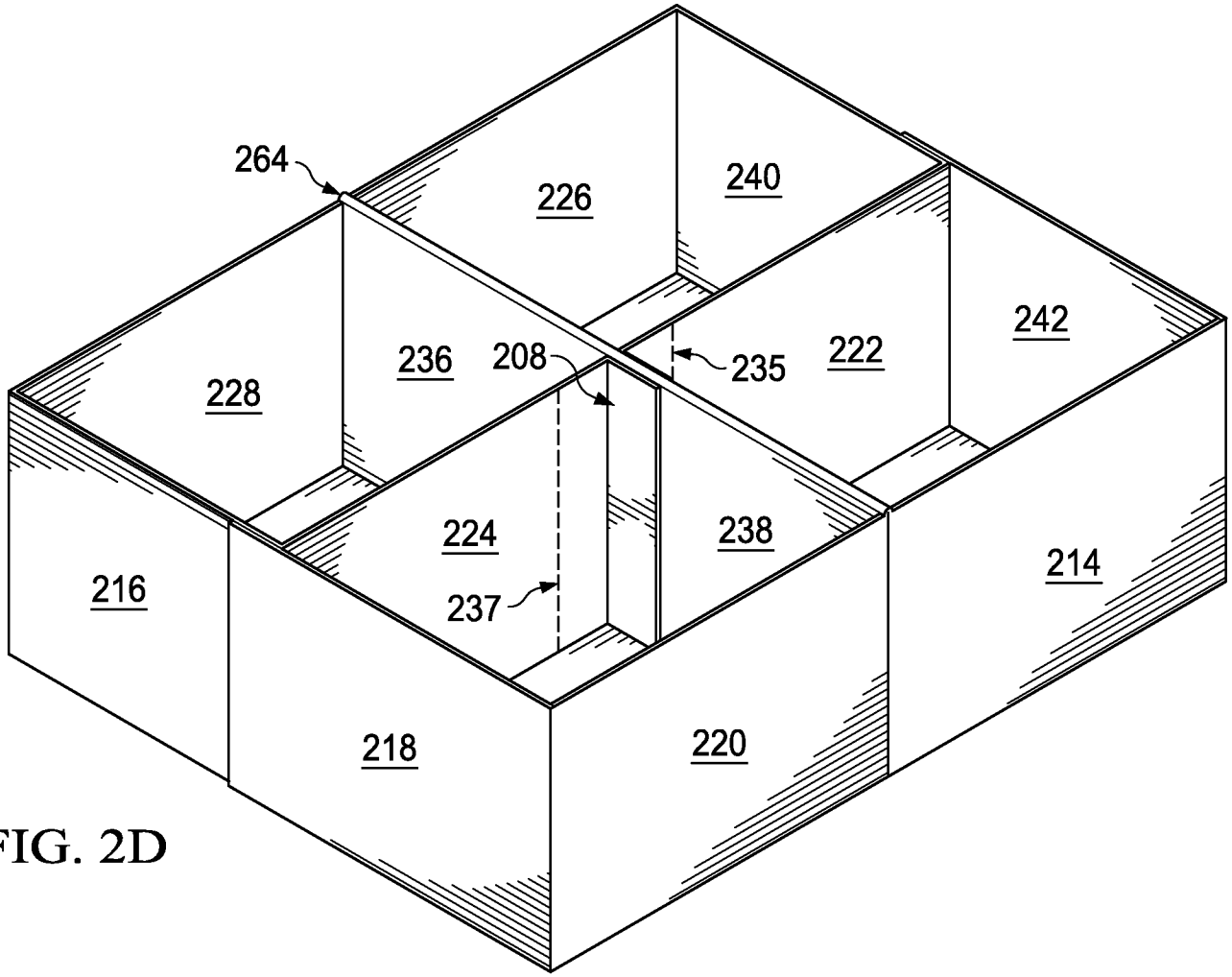

FIG. 2D illustrates the vertical compartmented insert of the present invention in a fully deployed condition. As with a prior art vertical compartmented insert, the vertical compartmented insert of the present invention is now ready for nesting in a corrugated cardboard box. As previously noted with regards to the prior art insert, a strong central ridge 264 is shown bisecting the compartmented insert. This strong central ridge 264 is the top edge of the divider referred to by Applicants' herein as the primary interior divider and consists of a folded corrugated cardboard sheet. Because the primary interior divider is made up of two corrugated cardboard sheets folded in the middle, it provides a strong support across the middle of the vertical compartmented insert.

Also shown in FIG. 2D are exterior panels 214, 216, 218, 220, interior panels 226, 236, 238, 240, 242, two interior dividers 222, 224, two perforation lines 235, 237, and an interior flap 208. The two interior dividers 222, 224, are referred to herein by Applications as the secondary interior dividers 222, 224. As will be described below, the secondary interior dividers 222, 224, consist of a single sheet of corrugated cardboard and can be detached from the primary interior divider by use of the perforation lines 235, 237. The secondary interior dividers 222, 224, are affixed to the primary interior divider by the flaps 208, 230.

As with the prior art insert, the embodiment shown in FIG. 2D provides in an initial configuration four individual compartments or cells. As will be shown below, however, an advantage of the present invention over the prior art is the quick and easy conversion of the vertical compartmented insert from a configuration having four compartments or cells to a configuration having three or even as few as two compartments or cells, thus providing flexibility in the size of the products that can be loaded within the insert.

Figure 2E:
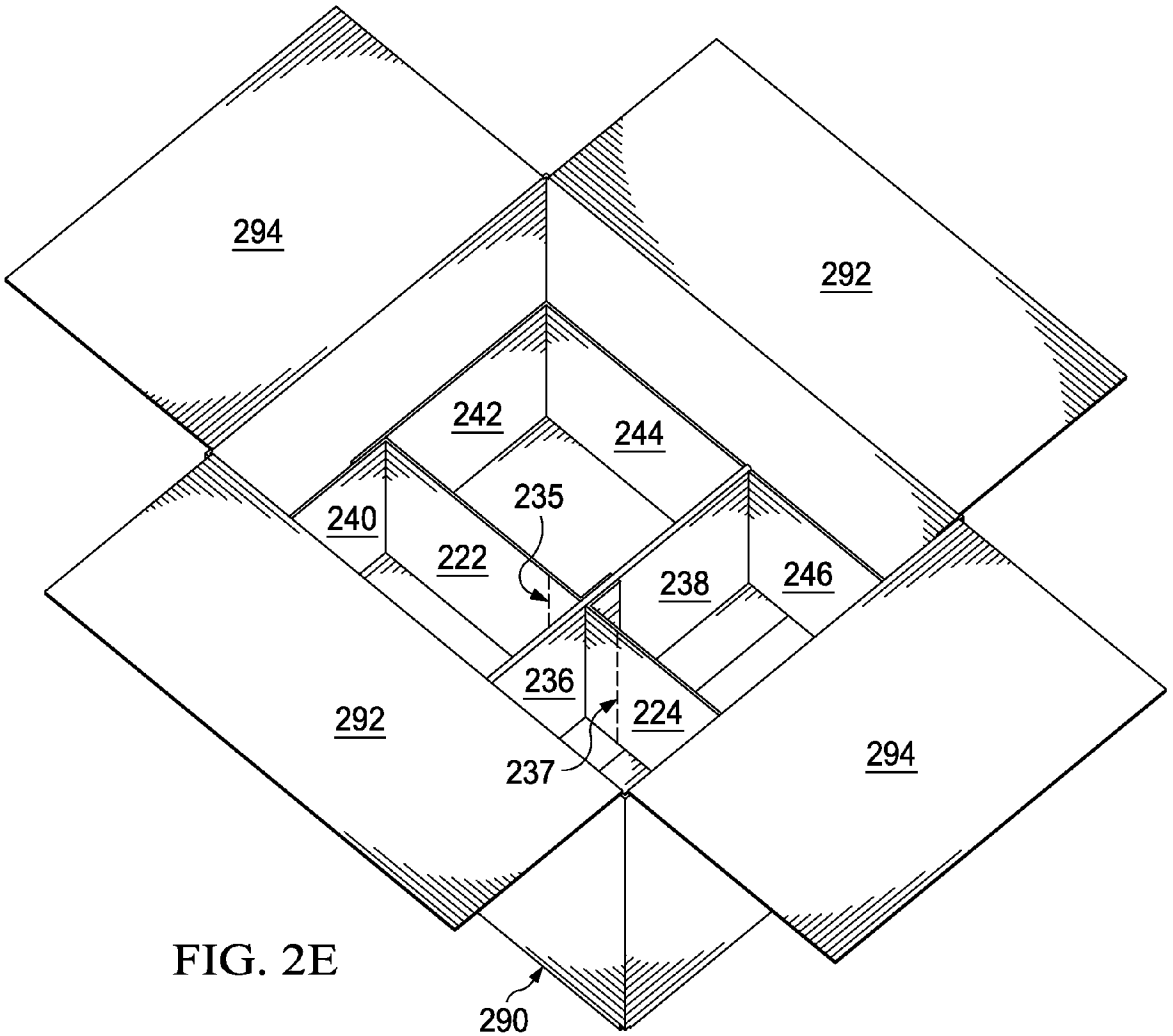

FIG. 2E shows the vertical compartmented insert of the present invention inserted in and nested with a corrugated box 290. The corrugated box 290 illustrated in FIG. 2E is shown in an open configuration with the flaps 292, 294 in relatively horizontal positions. The vertical compartmented insert illustrated in FIG. 2E is identical to the vertical compartmented insert illustrated in FIG. 2D. However, for ease of understanding in the following drawings, the orientation of the vertical compartmented insert of FIG. 2D has been rotated ninety degrees counter-clockwise when represented in FIG. 2E. The same orientation will be carried through with FIGS. 2F and 2G.

If no further modification of the first vertical compartmented insert is required to accommodate the desired load plan, then nothing further is required to be done to the first vertical compartmented insert. However, it may be desirable to reconfigure the first, and in this case lower, vertical compartmented insert from having four rectangular compartments to having three or even two rectangular compartments, depending on the desired loan plan.

The terms "load plan" and "load pattern" are used interchangeably hereby Applicants. It may be said that a corrugated box having two vertical compartmented inserts utilizing Applicants' packaging system has a first load pattern that consists of the product that will go in the box that will rest on the bottom of the box. Thereafter, a second required load pattern consists of the product that will be placed resting on a horizontal divider that creates a second tier in the box, as will be described further below.

Figure 2F:
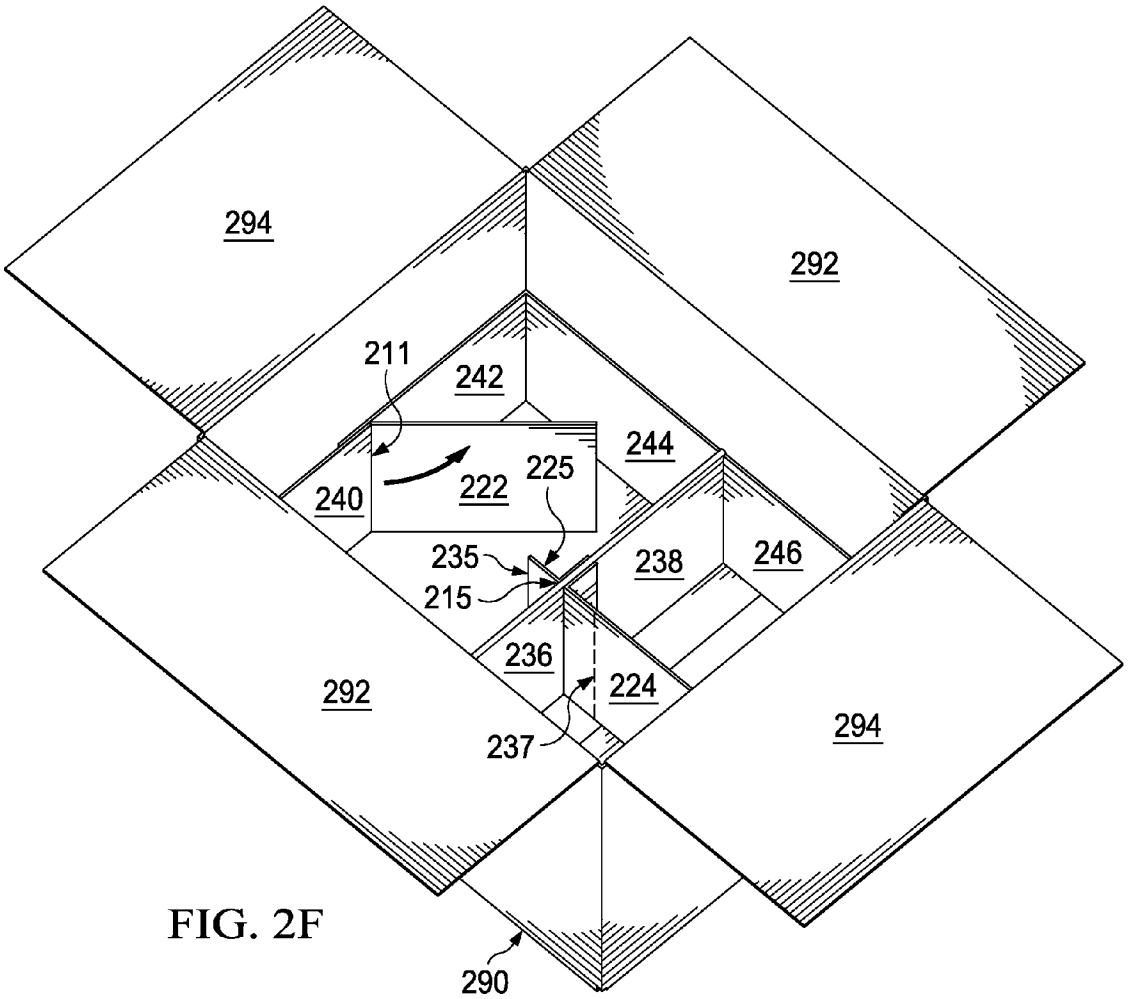
Figure 2G:
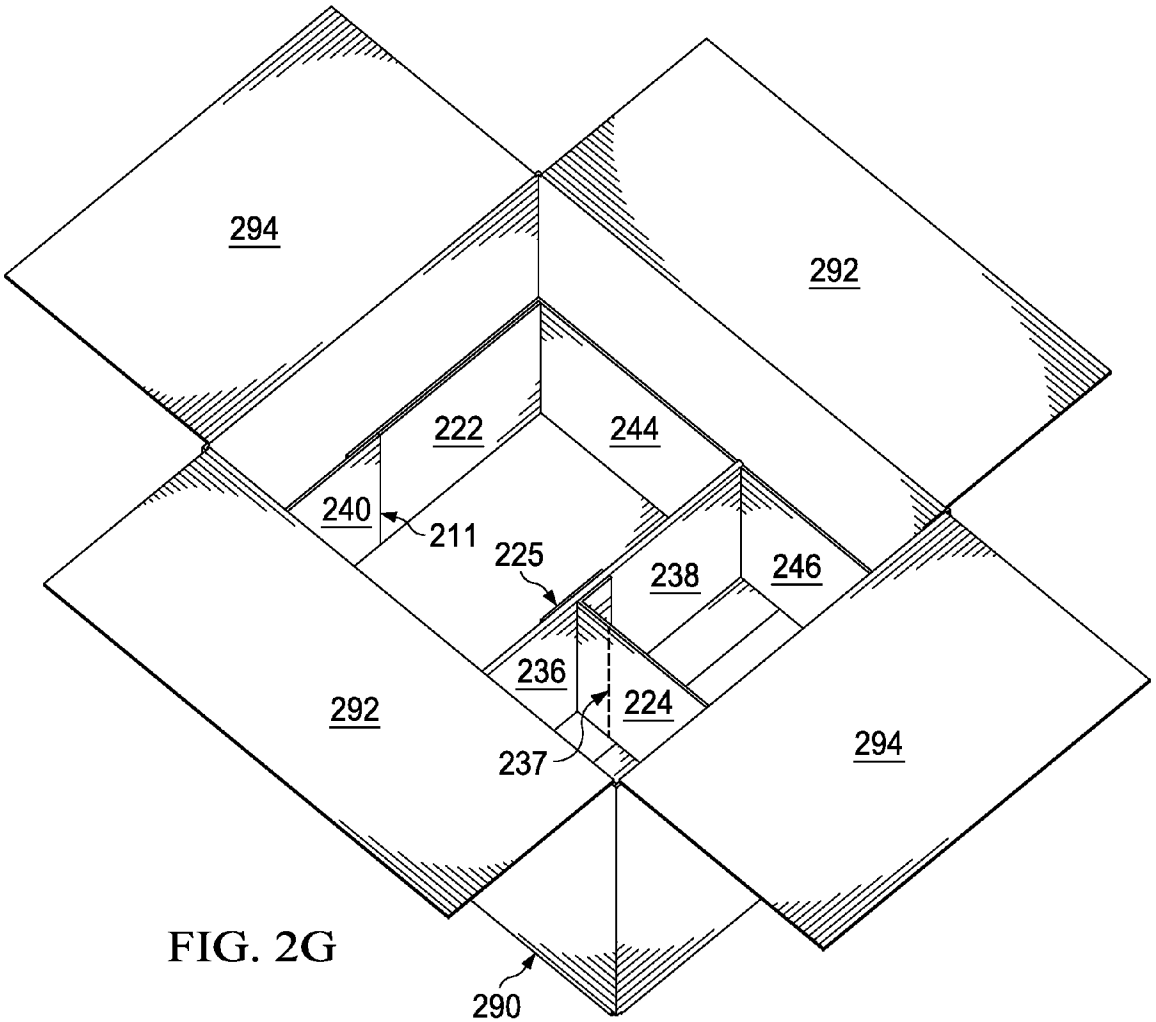

The functionality described above regarding changing the configuration of a vertical compartmented insert from four to three or two cells is illustrated in FIGS. 2F and 2G. Referring to FIG. 2F, it can be seen that the perforation line 235 on one of the secondary interior dividers 222 is broken and that the divider 222 is being rotated away from its previous position along a hinge 211 towards an interior panel 242. This motion is continued until this divider 222 is placed in a position abutting and parallel with the interior panel 242 of the vertical insert. The remaining portion 225 of the divider 222 can also be rotated in the opposite direction to abut with and parallel the adjoined primary interior divider. As shown in FIG. 2G, this results in a vertical compartmented insert having one large rectangular compartment and two smaller rectangular compartments. Likewise, the other perforated divider 237 can be broken away from its contact with the primary or center divider (shown as two panels 236, 238) in order to transform the vertical compartmented divider into two rectangular compartments or cells.

As discussed previously, the location of the perforation lines 235, 237 can vary. Using the dimensions for the cells of the vertical compartmented insert described above as an example, it can be understood that one placement of the perforation line 235 should allow for the remaining portion of the secondary interior divider 222 to match the length of the interior panel 242 with which it will abut, as illustrated in FIG. 2G. Consequently, if the interior panel 242 is 8.25 inches wide and the divider 222 is 10.25 inches wide, then the perforation line 235 is located 2 inches from the rotation point 215 or, stated differently 2 inches from the primary interior divider. Alternatively, as an example, the perforation line 235 could be located much closer to the rotation point 215, such as a quarter of an inch from the rotation point 215, in such instance the major portion of the divider of 222 that will abut with the interior panel 242 is slightly longer than the interior panel 242. This additional length can be accommodated by bending the now unattached end of the divider 222 of FIG. 2F such that the majority of the remaining portion of the divider 222 will abut with the interior panel 242 with a smaller portion abutting with the perpendicular interior panel 244.

Figure 3A:
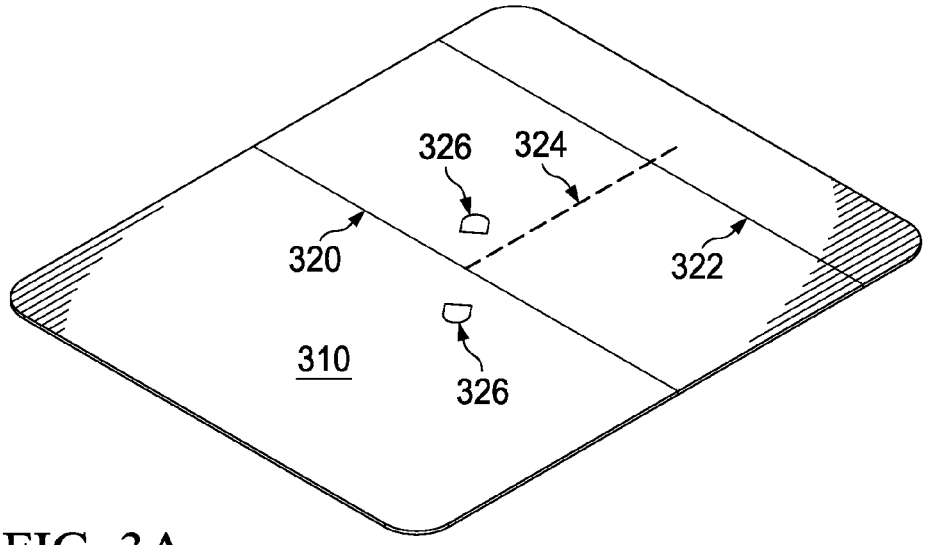
FIGS. 3A, 3B, 3C, 3D, 3E, and 3F illustrate one embodiment of a horizontal divider of the present invention.

Another component of the packaging system is the horizontal divider 310 illustrated in FIG. 3A in a preferred embodiment. (Applicants use the terms "horizontal insert" and "horizontal divider" interchangeably herein). Depending on the desired load configuration or load plan, the horizontal divider can be placed without change on top of the reconfigured vertical compartmented divider shown in FIG. 2G or 2E (as is done in the prior art), or it can be reduced in size by one quarter or one half by means that will be explained shortly. If no further reconfiguring of the horizontal divider 310 is desired, then when placed on top of the vertical compartmented insert show in FIG. 2G or 2E the horizontal divider 310 becomes the top seal over the first vertical compartmented insert and a floor for a second vertical compartmented insert, as will be described below. However, it may be desirable, dependent on the load plan to place in the first or lower vertical compartmented insert objects that are taller than the vertical height of the panels of the compartmented insert. In such instance, the horizontal insert 310 can be reconfigured to allow items to protrude above the first vertical compartmented insert into a second vertical compartmented insert. This is accomplished by a pair of parallel score lines 320, 322 and one perforation line 324. It is this functionality provided by the score lines 320, 322 and the perforation line 324 that distinguishes this component of Applicants' system over prior art horizontal box inserts.

Referring to FIG. 3A, two parallel score lines 320, 322 are illustrated, one 320 running in the center of the horizontal divider 310 and the other 322 nearer one edge. These two score lines 320, 322, can thus be referred to separately as a center score line 320 and an edge score line 322. The score lines 320, 322 are perpendicular to a perforation line 324 which starts at the center score line 320 and bisects the edge score line 322 without extending all the way to the edge or end of the horizontal divider. In a preferred embodiment, the perforation line 324 stops before reaching the edge of the horizontal divider in order to provide additional strength to the horizontal divider 310. However, in an alternative embodiment, the perforation 324 can continue to the edge of the piece 310.

As with the previously-described vertical compartmented insert, the horizontal insert 310 can vary in dimension depending on the width and length of the corrugated cardboard box in which the horizontal insert 310 will be used. As an example only, using dimensions to correspond to the example dimensions provided above for the vertical compartmented insert, the horizontal insert illustrated in FIG. 3A is about 20.5 inches long and about 16.5 inches wide. Thus the distance from the center score line 320 to the edge score line 322 in such embodiment is 7.25 inches, and the perpendicular distance from the center score line 320 and either end of the insert 310 is 10.25 inches. For reasons that will be understood when discussing FIGS. 3F, 4D, and 4E, the distance between the edge score line 322 and the edge or end of the horizontal insert 310 is 3 inches. The distancing between the parallel score lines 320, 322 are dependent on the height of the panels of the vertical compartmented insert. Specifically, in a preferred embodiment, the center score line (also referred to by Applicants as a first score line) 320 and the edge score line (also referred to by Applicants as a second score line) 322 is equal to the height of a vertical compartmented insert when deployed. Again, it should be noted that the first score line 320 and the second score line 322 are always parallel in this embodiment.

Also shown in FIG. 3A are two finger holes 326 to allow for easy installation and removal of the horizontal divider 310. These finger holes 326 are cut in the horizontal divider 310 in a preferred embodiment. The finger holes 326 are optional to the invention.

Figure 3B:
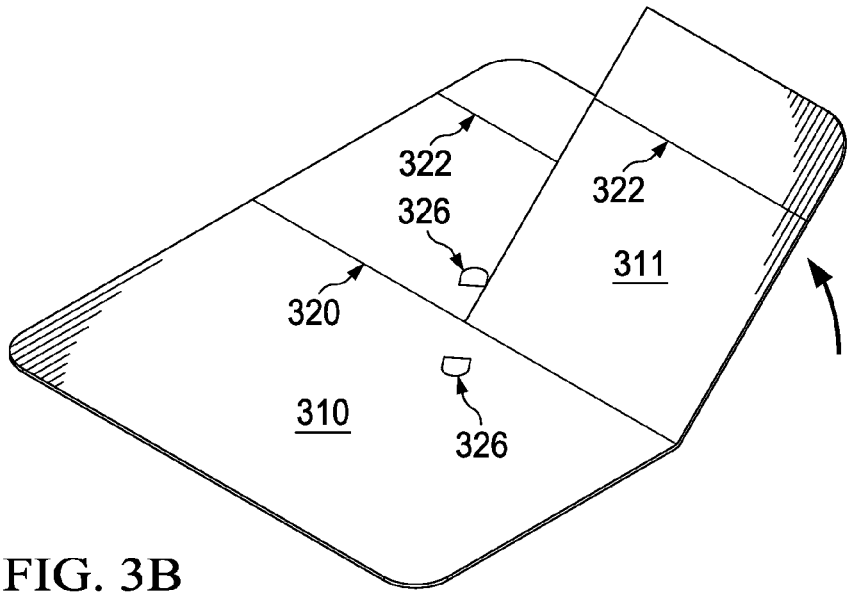
Figure 3C:
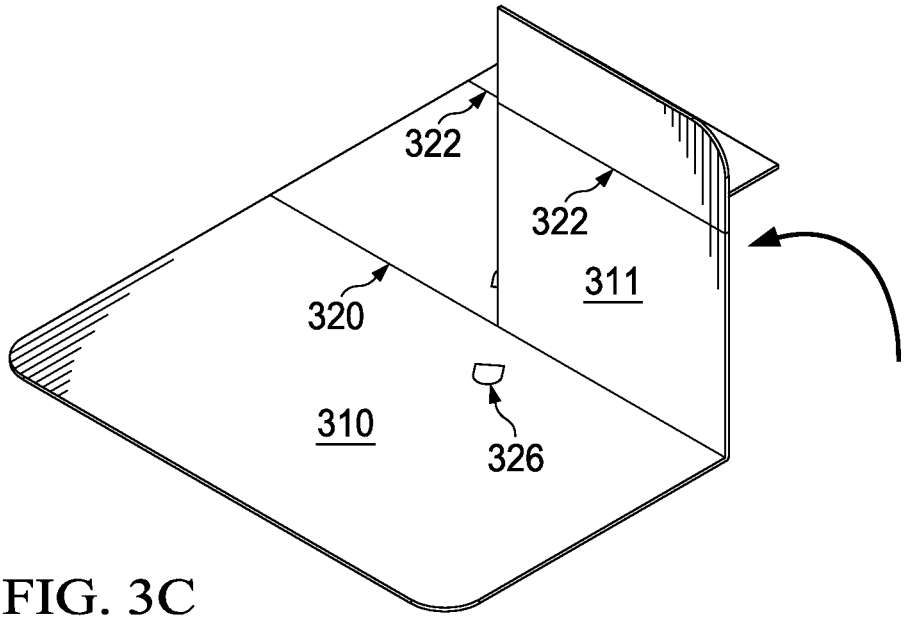
Figure 3D:
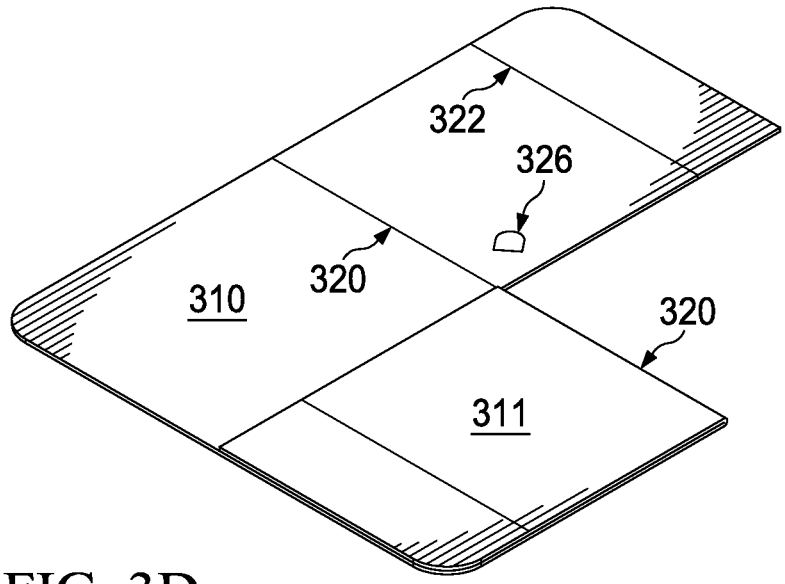

The functionality of the perforation line 324 can be seen in FIGS. 3B, 3C, and 3D. Specifically, when it is desirable that a quarter 311 of the divider 310 be in essence removed, the perforation 324 is broken such that a quarter 311 of the panel can be folded about the first or center score line 320. In a preferred embodiment, the perforation is oriented in the same plane as the corrugated ridges internal to the divider 310, thereby promoting a generally straight tear through the end of the panel.

Using the example dimensions described above for the horizontal insert 310, a perforation line 324 is 8.25 inches long. Thus, it can be said that the horizontal insert 310 in a preferred embodiment has a perforation pattern consisting of a perforation line 324 that starts at a first score line 320 and extends perpendicularly from said first score line 320 to bisect a second score line 322. In the embodiment illustrated this perforation pattern or perforation line 324 of the horizontal insert 310 stops short of the end of the horizontal insert 310 after bisecting the second score line 322. This provides for additional strength in the horizontal insert 310 without compromising the functionality of the perforation line 324, as will be described further below.

FIG. 3B shows the quarter section 311 being rotated upwards as it is being removed from its previous position. FIG. 3C shows the continuation of this motion. The quarter section 311 is now approximately perpendicular to the rest of the insert 310. Finally, FIG. 3D shows the completion of this operation with the quarter section 311 now abutting the rest of the horizontal insert 310 and in the same horizontal plane. In this configuration the horizontal insert 310 can now be placed on top of the first vertical compartmented insert in order to allow communication between one of the lower rectangular compartments and the space above the horizontal divider 310.

Figure 3E:
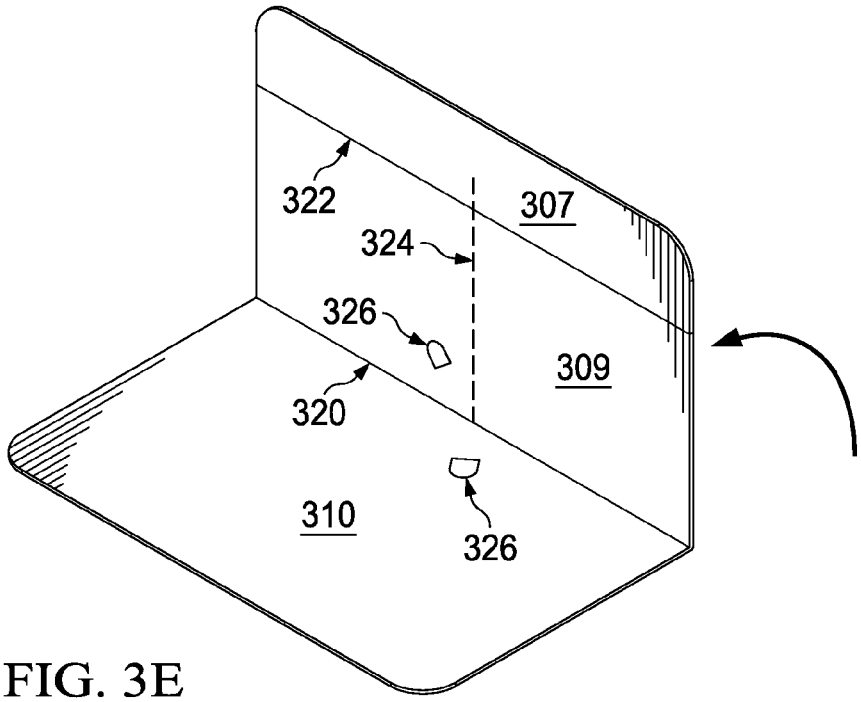
Figure 3F:
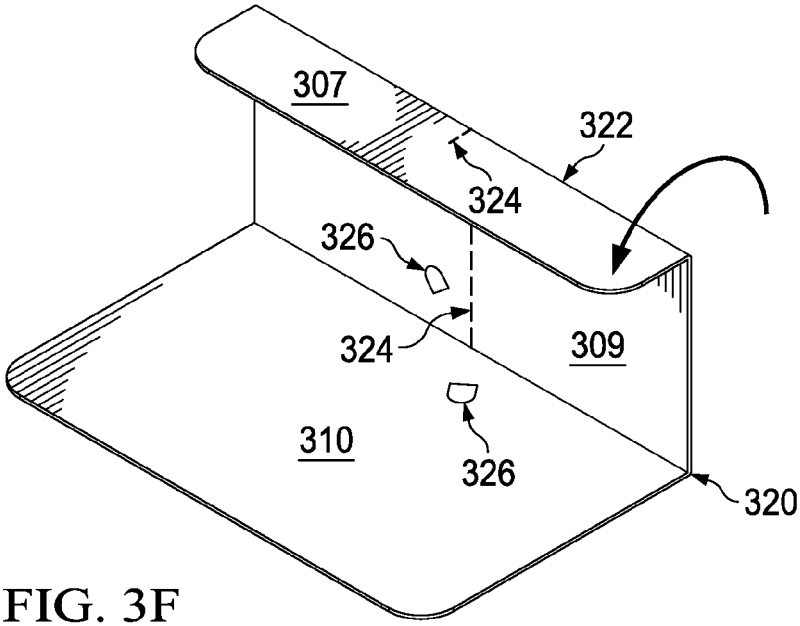

Another functionality of the horizontal insert 310 involves the two score lines 320, 322. This functionality is shown in referenced FIGS. 3F and 3E. FIG. 3E shows the dividers being folded about the first or center score line 320 in order to reduce the size of the horizontal divider in half. For reasons that will be described below, in a preferred embodiment the horizontal divider 310 is folded such that one half is perpendicular to the other half. Thus, the horizontal insert 310 is foldable in half along the first score line 320. In conjunction with a vertical compartmented insert, once the horizontal divider 310 is in the perpendicular configuration, as shown in FIG. 3E, it is placed inside the corrugated box with the lower, horizontal portion of the horizontal divider 310 acting as the ceiling to a lower vertical compartmented insert and the floor to an upper vertical compartmented insert. The now vertical half 309 of the horizontal divider 310, comprising the quarter panel 311 and an upper flap 307, is placed flush with an interior side wall of the corrugated box. Once the second or upper vertical compartmented insert is placed on top of the horizontal component of the horizontal divider 310, the upper flap 307 is folded down, rotating about the second or outer score line 322, as illustrated in FIG. 3F.

Figure 4A:
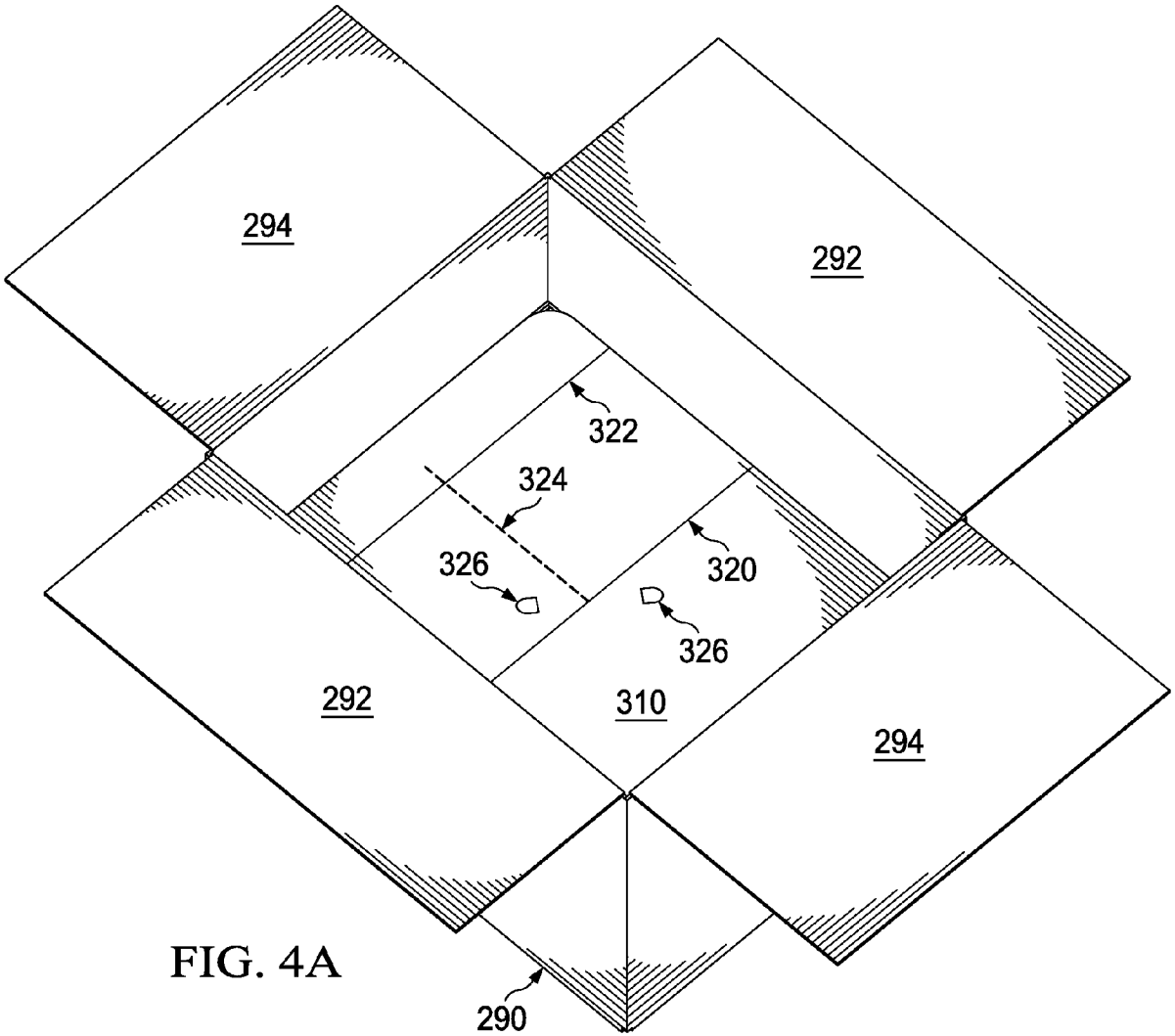
FIGS. 4A, 4B, 4C, 4D, 4E, and 4F illustrate one embodiment of the packaging system of the present invention.

The functionality of a preferred embodiment of the invention will now be described with reference to various load accommodating configurations (for various load patterns or plans) illustrated by FIGS. 4A, 4B, 4C, 4D, 4E, and 4F. Referring to FIG. 4A, a corrugated box 290 is show with the flaps 292, 294 in a horizontal positon, thus providing an opening in the box 290. Also shown is a horizontal divider 310, with its finger holes 326, center score line 320, edge score line 322, and perforation line 324. In the embodiment shown in FIG. 4A, the horizontal divider 310 is resting on top of a first or lower vertical compartmented insert (not shown). This lower compartmented insert may be in any number of configurations such as those previously illustrated in FIGS. 2E, 2G, or in the two compartments or cell configuration (not illustrated).

Figure 4B:
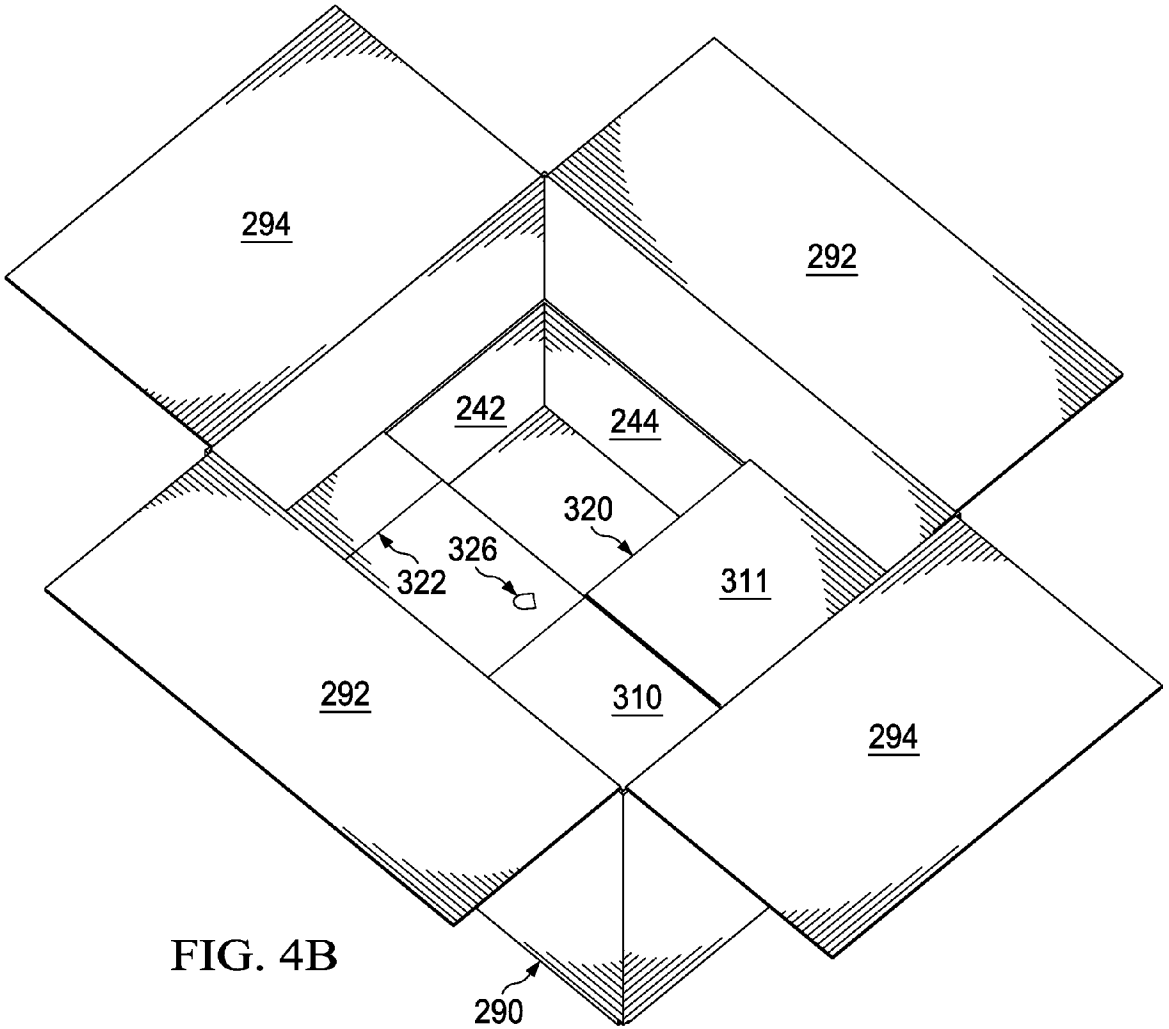

Referring to FIG. 4B, again a corrugated box 290 is shown in an open position with the flaps 292, 294 nearly horizontal. The configuration illustrated in FIG. 4B shows a horizontal divider 310 with one quarter portion 311 removed as previously illustrated by FIGS. 3B, 3C, and 3D. It can be seen that the perforation pattern 324 of the horizontal divider 310 (FIG. 3A) aligns with at least one interior divider of the first vertical compartmented insert. This configuration allows for vertical access through the horizontal divider 310 to the vertical compartmented insert below while still maintaining support for the horizontal insert 310. Two interior panels 242, 244, can also be seen of this lower vertical compartmented insert.

Figure 4C:
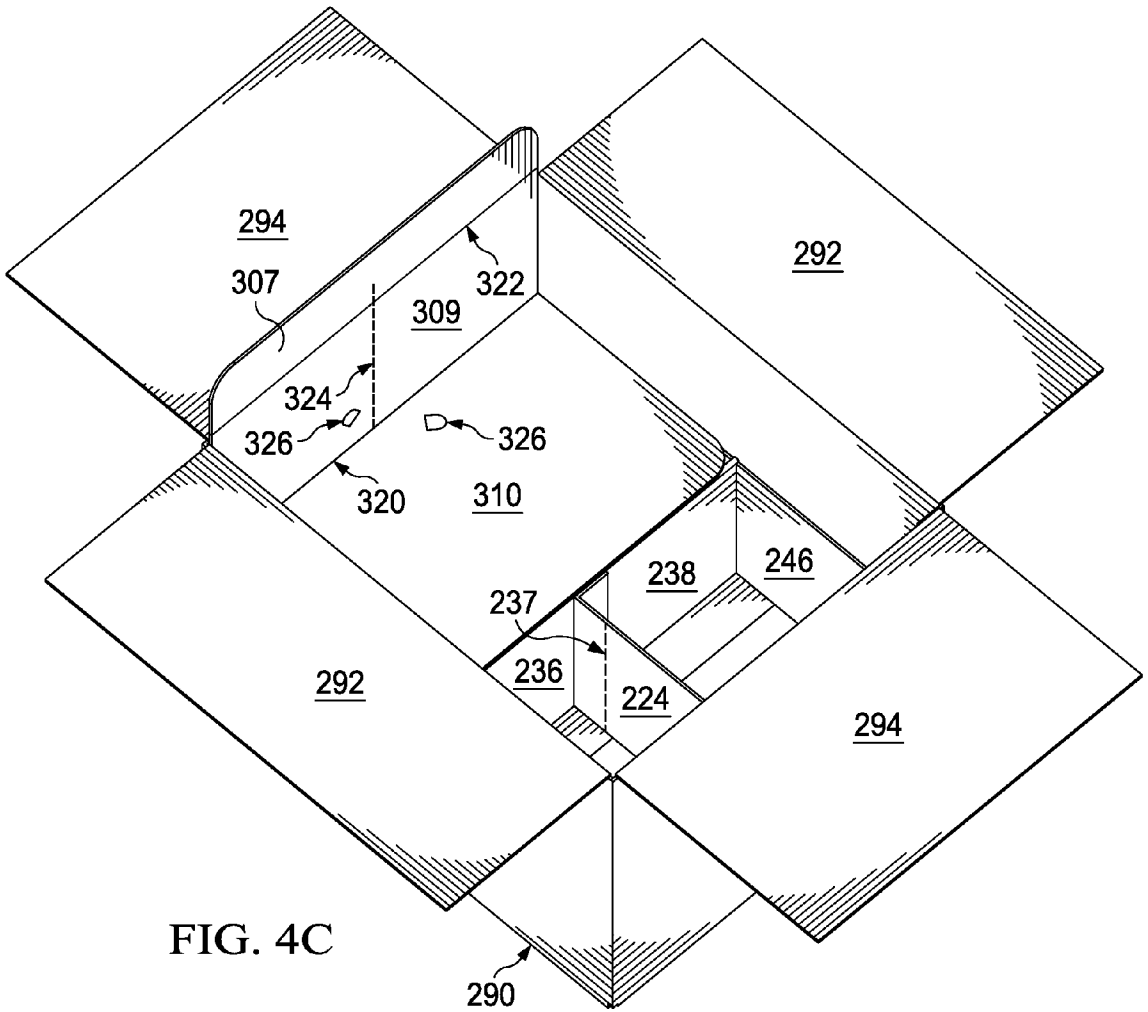

FIG. 4C illustrates another configuration constructed using the functionality of the instant invention. Again, a corrugated box 290 is shown with the flaps 292, 294 in a position allowing for an opening in the corrugated box 290. The horizontal divider 310 is shown in a folded configuration as previously illustrated in FIG. 3E. Consequently, the vertical half 309 of the horizontal divider 310 shown with the upper flap 307 abuts an interior wall of the corrugated box 290. Also shown is the perforation line 234, which has no functionality in this configuration. FIG. 4C shows the horizontal divider 310 thus installed and reveals two cells or compartments of the lower or first vertical compartmented insert with two panels 236, 238 on a center divider or primary interior, a secondary interior divider 224, and an interior panel 246. The perforation line 237 is illustrated, and it can be understood that this line 237 can be broken in order to fold back the interior divider 224 and thus provide for a larger lower cell.

Figure 4D:
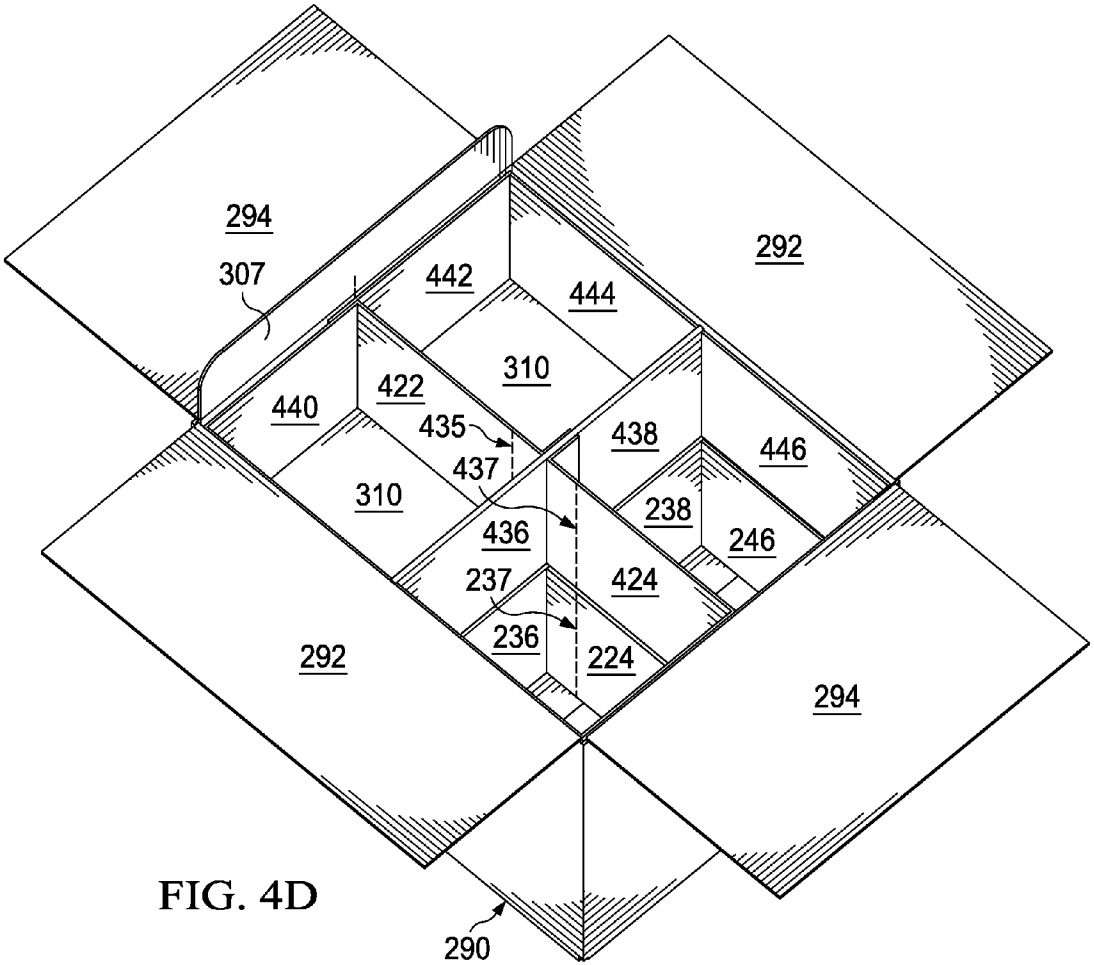

FIG. 4D is continuation of FIG. 4C wherein a second or upper vertical compartmented insert has been nested inside the corrugated box 290 on top of the horizontal portion of the horizontal divider 310. Shown from this upper vertical compartmented insert are interior panels 440, 442, 444, 446, dividers 422, 424, and further interior panels 436, 438 which are a part of the center or primary divider of the upper vertical compartmented insert. Also shown are two perforation lines 435, 437. The illustration of the upper flap 307 of the horizontal divider shows that the vertical portion of the horizontal divider is now between the upper vertical compartmented insert and an inner wall of the corrugated box 290.

Figure 4E:
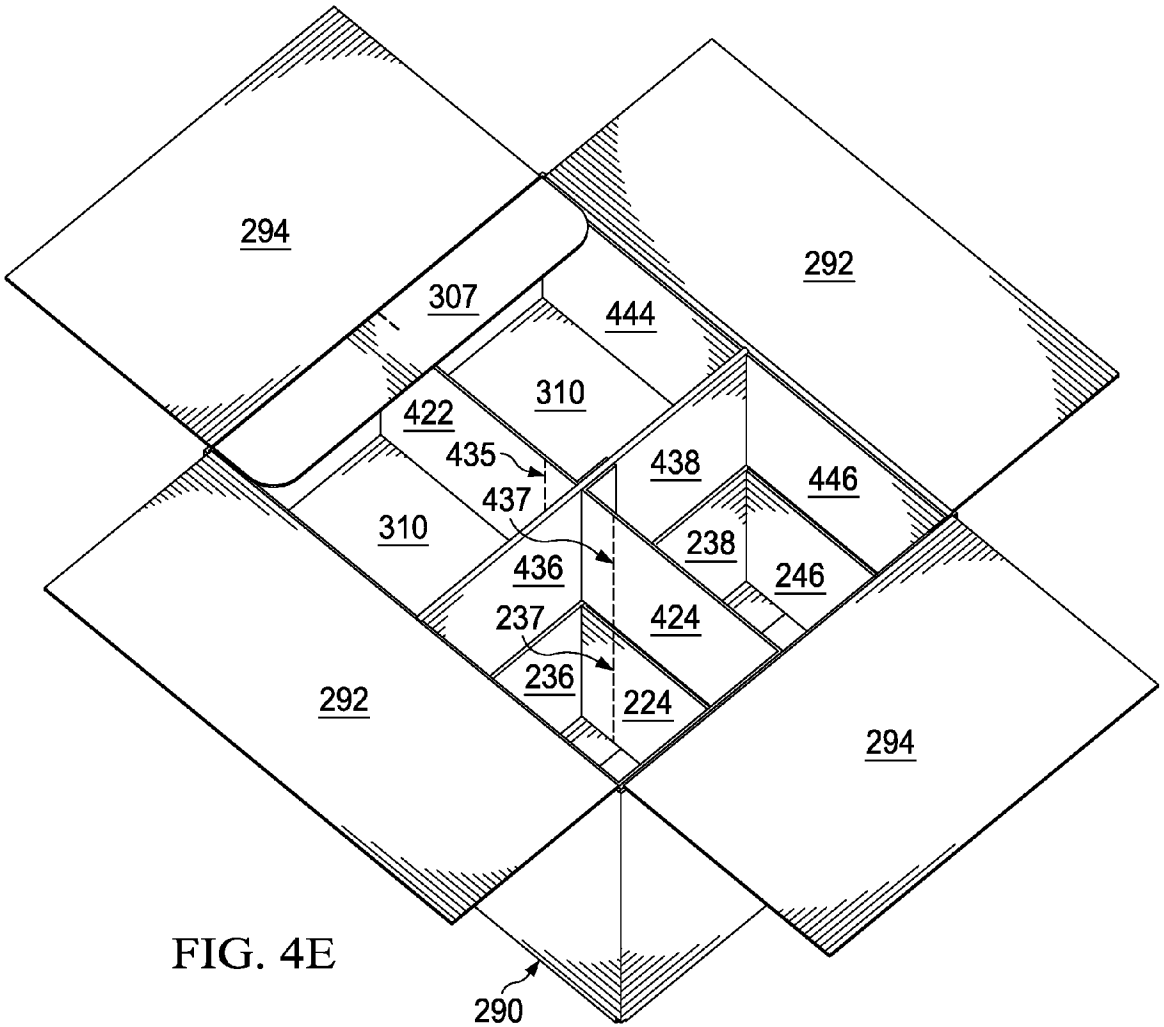

FIG. 4E is a continuation of FIG. 4D with the upper flap 307 of the horizontal divider 310 folded over the upper vertical compartmented insert. Once filled with product, the corrugated box 290 can now be closed by rotating the box flaps 292, 294 to a closed position and sealing the box 290.

Figure 4F:
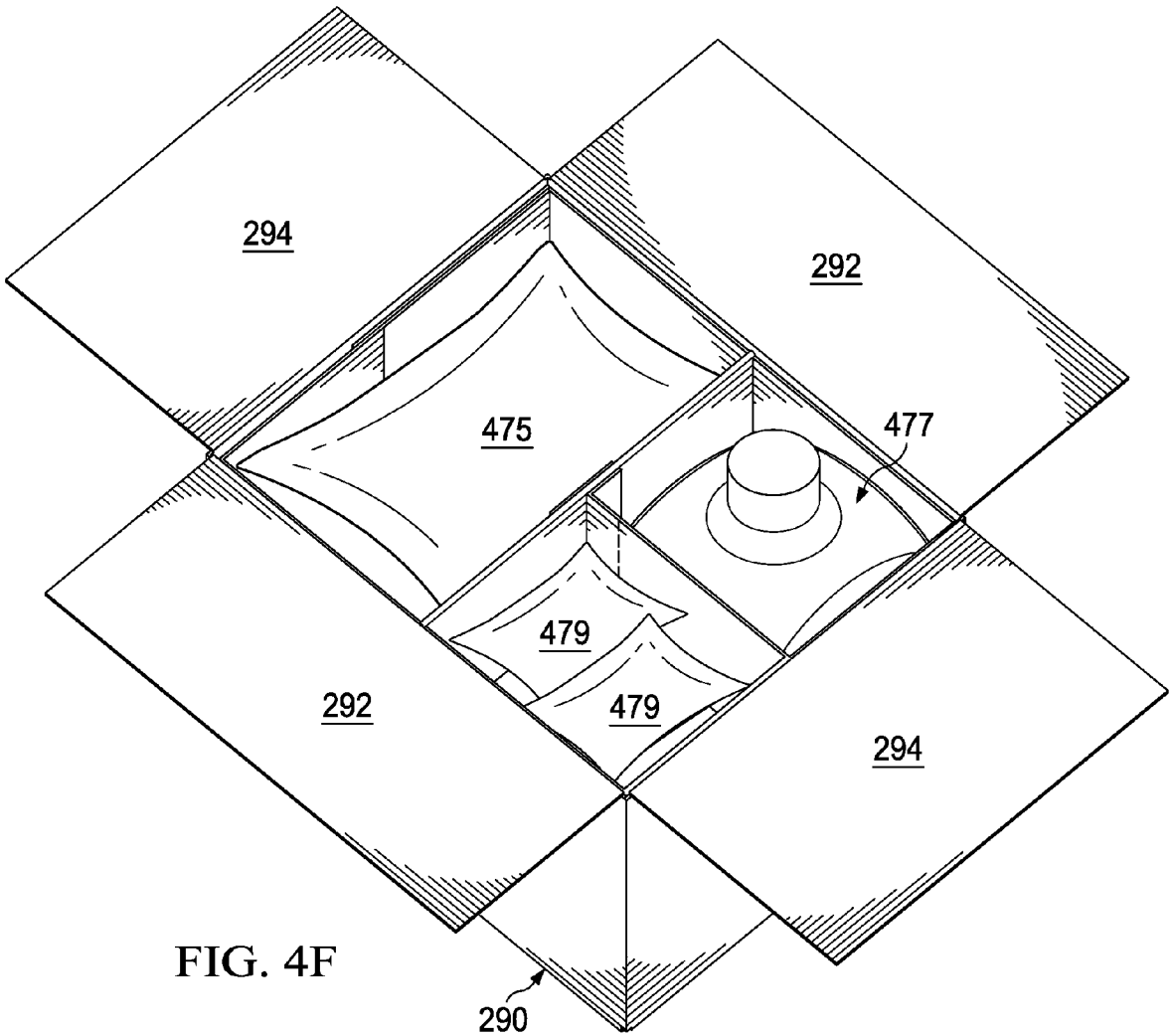

An illustration of a corrugated box 290 with a particular example load plan is illustrated in FIG. 4F. Once again a corrugated box 290 is shown with flaps 292, 294 in an open position. A large and tall container 477 such as might commonly hold laundry detergent has been placed in one vertical cell. This can be accomplished when a quarter panel of the horizontal insert has been removed allowing the container 477 to protrude above the horizontal plane of the horizontal divider. In the upper portion of the figure a large sack like object 475 has been placed in a longer cell or compartment of the upper vertical compartmented insert. Such object 475 might be a bag of cat litter, a plastic sack having cereal or candy contained therein, or a large pillow bag, such as a large bag of corn chips. This longer compartment or cell in which this bag 475 fits snugly has been formed by the functionality of the vertical compartmented insert previously illustrated in FIGS. 2F and 2G. Finally, two smaller bag items 479, which might be smaller pillow bags having potato chips contained therein, for example, are also shown in a smaller compartment or cell. All of these items 475, 477, 479, as well as other items that cannot be seen that are in the lower half of the box 290 are isolated in their own compartments or cells. Thus, no individual item in the container relies on an adjacent item for stability, load bearing, or protection. Instead, each individual container or cell isolates each of the items loaded in Applicants' packaging system regardless of the orientation of the box 290 after it has been sealed and during shipment.

It can be understood that the flexibility of the instant packaging system and its components provides for a larger variety of configurations that can accommodate any number of different load plans or load patterns. The examples provided by the drawings are only a few of the potential configurations.

Figure 5A:
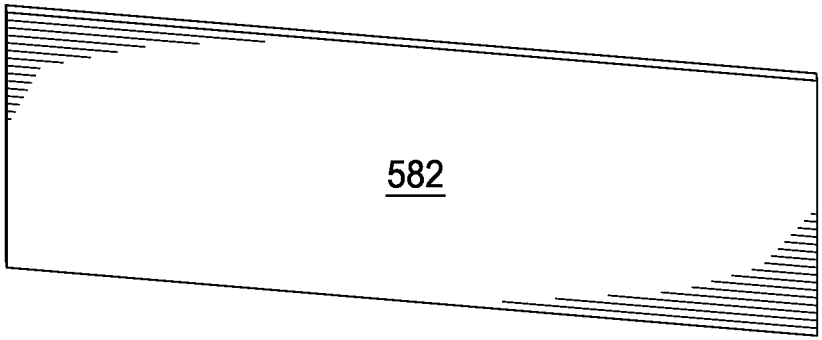
FIGS. 5A, 5B, and 5C illustrate one embodiment of a diagonal insert panel of the present invention.
Figure 5B:
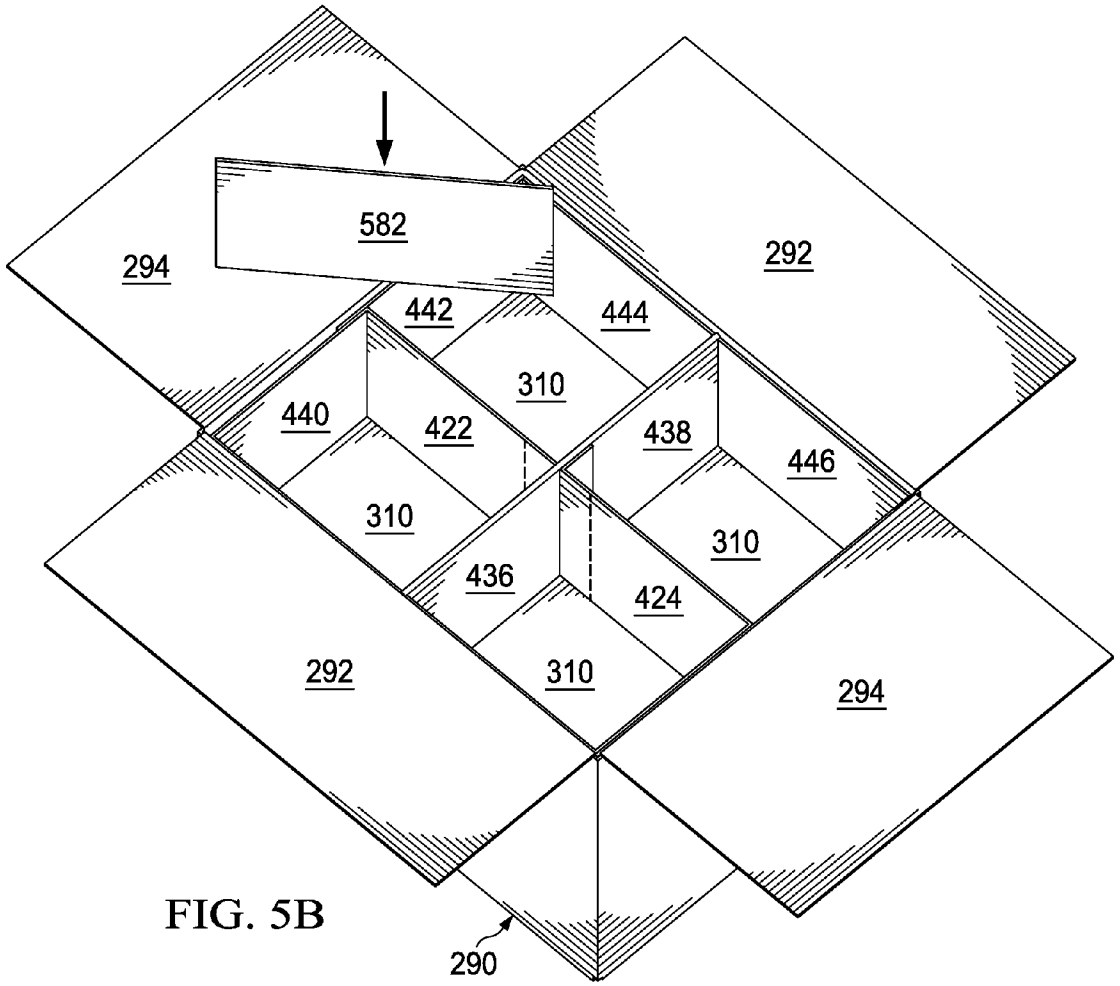
Figure 5C:
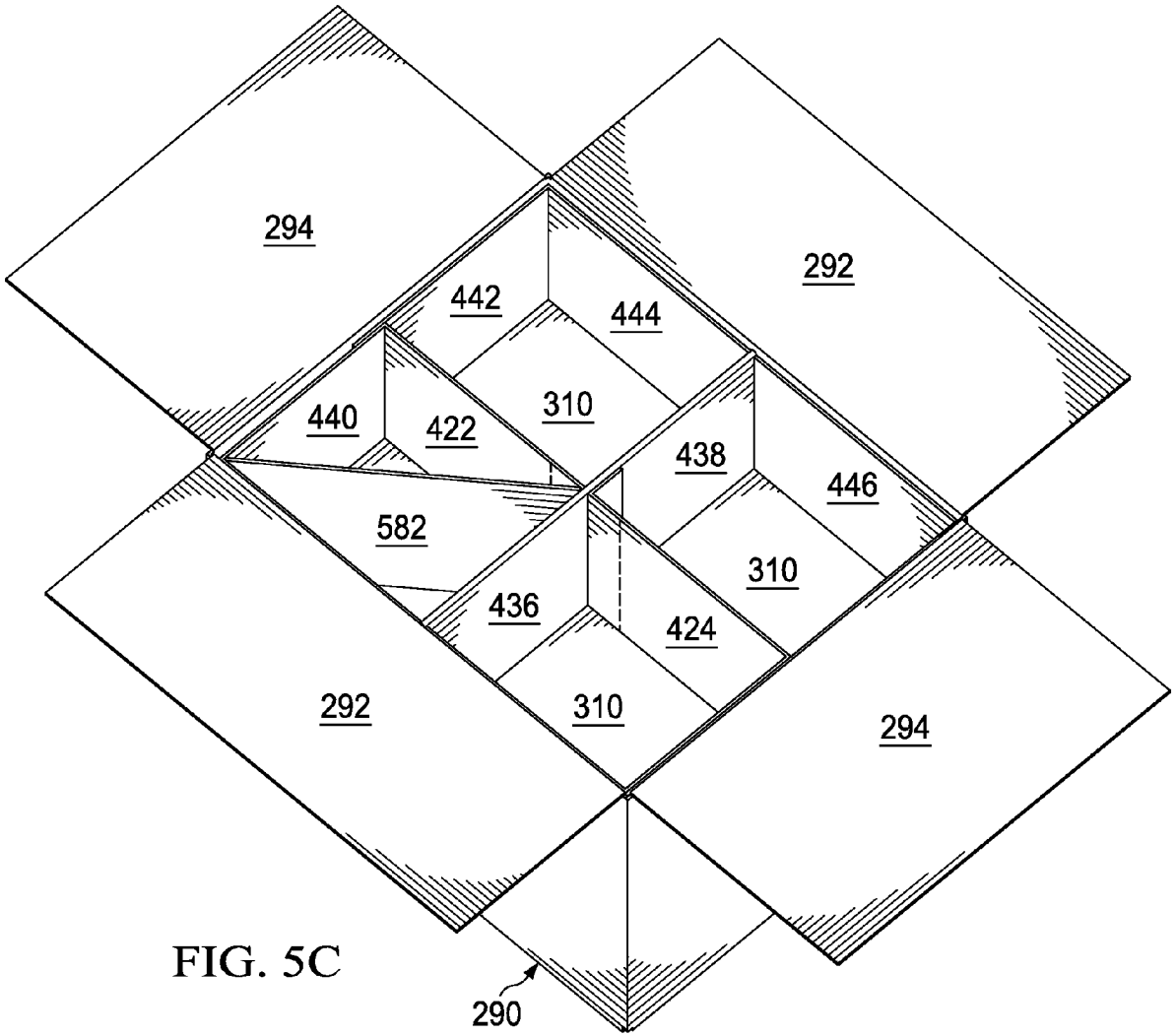

Another optional element of one embodiment of the instant invention involves a vertical diagonal insert 582 illustrated in FIGS. 5A, 5B, and 5C. This diagonal insert 582, in a preferred embodiment, is a piece of corrugated cardboard. The length of the diagonal insert 582 should correspond to the diagonal dimensions of the cell or compartment in which it will be placed. This can best be understood by referring to FIGS. 5B and 5C.

FIG. 5B again shows a corrugated cardboard box 290 with the flaps 292, 294 in an open position. A horizontal divider 310 is shown acting as a floor to an upper or second vertical compartmented insert. This upper vertical compartmented insert is shown with interior panels 440, 442, 444, 446, two dividers 422, 424, and two interior panels 436, 438 which are part of the primary or central interior divider of the vertical compartmented insert. Illustrated in elevation in FIG. 5B is the diagonal divider 582 prior to installation in one of the compartments or cells.

This installation is shown completed in FIG. 5C. It can be seen that the horizontal divider 582 is of the same approximate height of the various panels 440, 442, 444, of the second vertical compartmented insert. The diagonal divider 582 is of a length equivalent to the distance between opposing corners of the divided compartment or cell, which in the illustrated example comprises a side wall 440 and divider 422. Thus, the diagonal divider 582 is a vertical insert having a length equal to the diagonal distance from opposing corners of one of the rectangular compartments of a vertical compartmented insert.

Figure 6A:
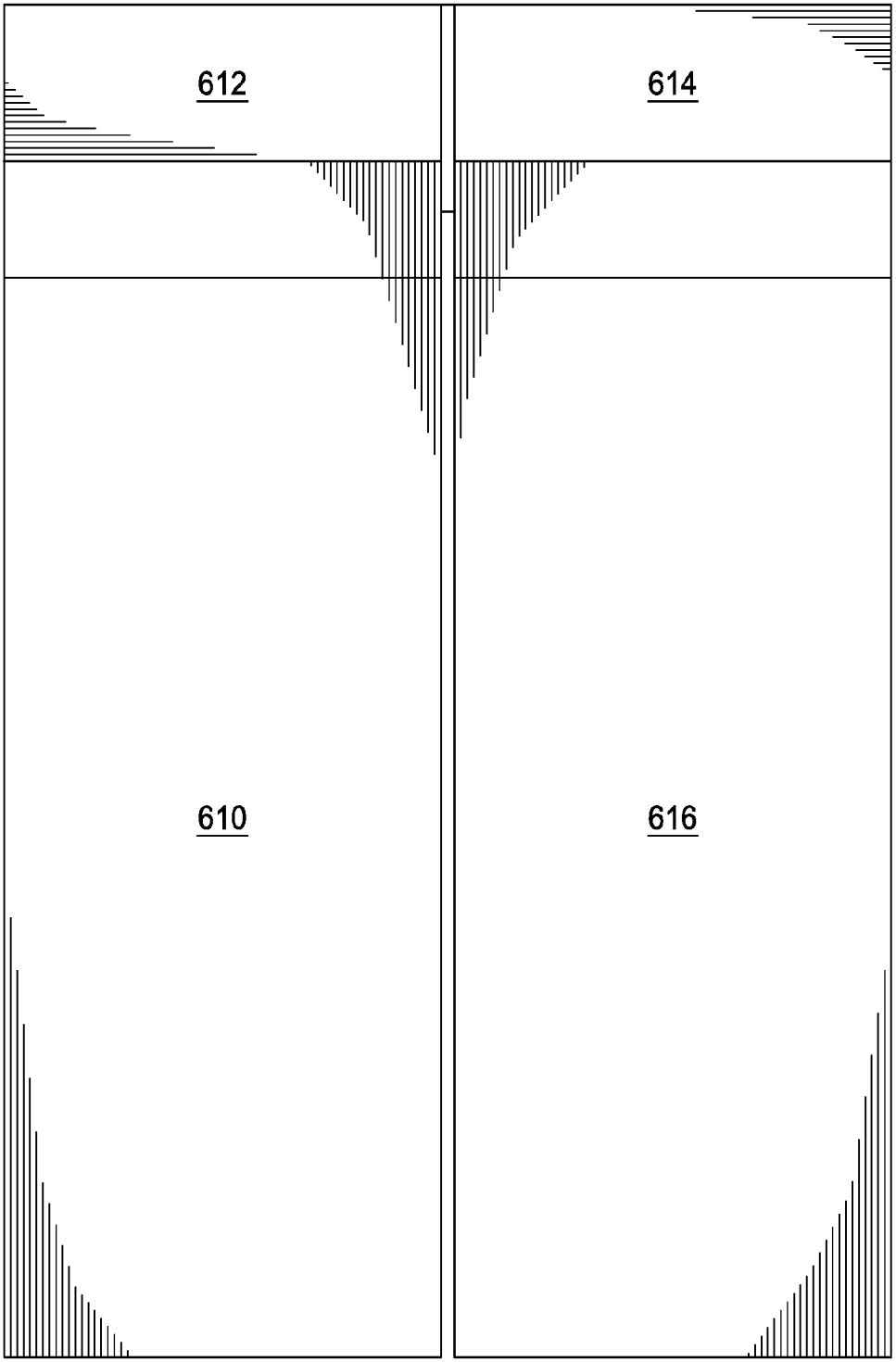
FIGS. 6A, 6B, 6C, and 6D illustrate a second embodiment of a packaging system of the present invention.
Figure 6B:
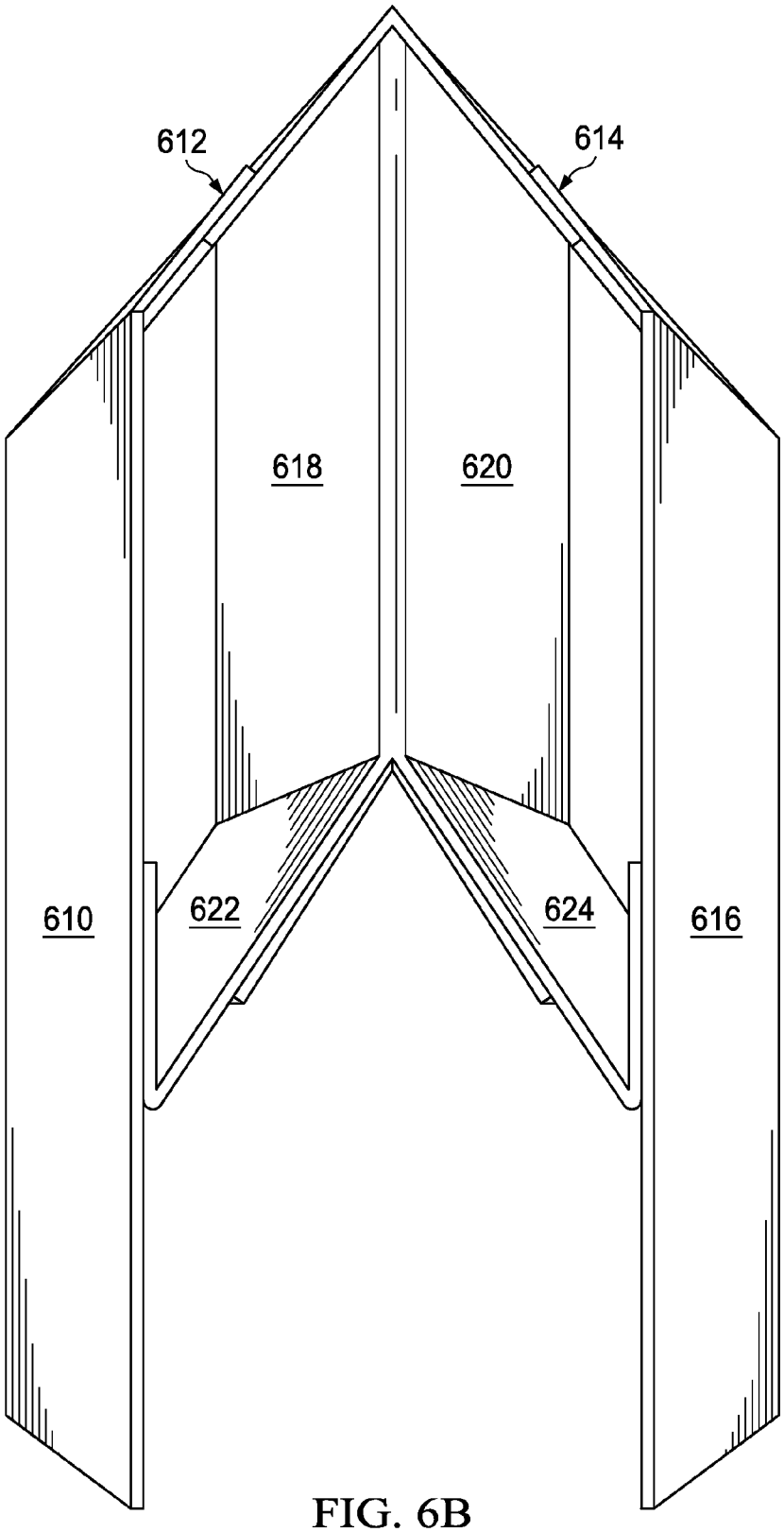
Figure 6C:
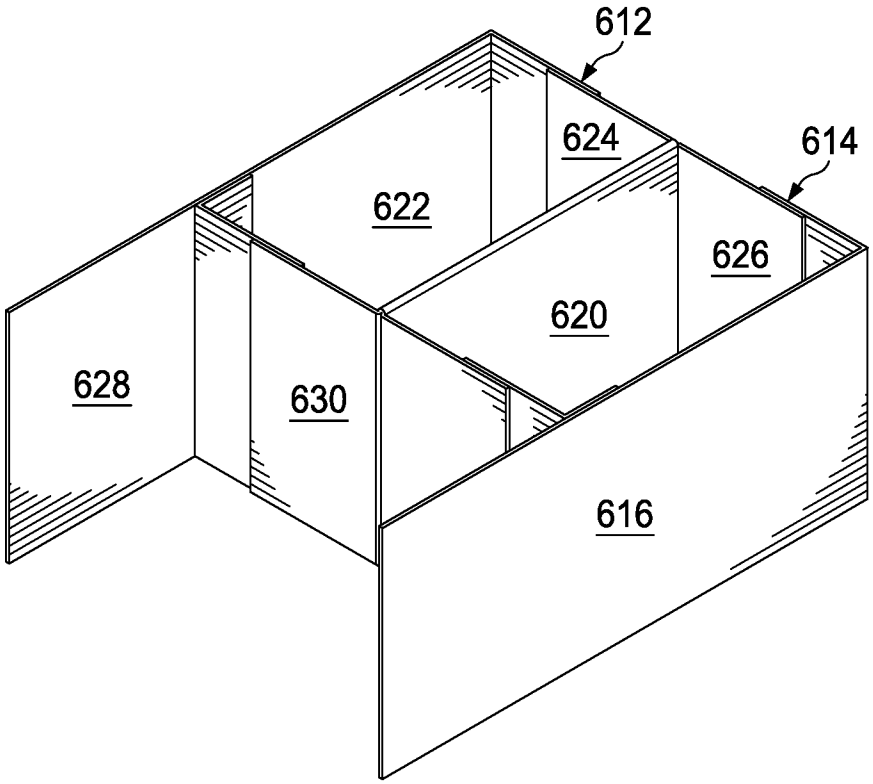

A second embodiment of the invention involves a preconfigured, three cell vertical compartmented insert. FIG. 6A shows this embodiment in a flat position with four panels 610, 612, 614, 616 evident. FIG. 6B shows this embodiment partially deployed. In addition to the panels 610, 612, 614, 616 illustrated in FIG. 6A, FIG. 6B also reveals interior panels 618, 620, 622, 624. FIG. 6C shows this three cell embodiment in a fully deployed position. While two panels 612, 614 are no longer visible, FIG. 6C shows an exterior wall 616 and several interior panels 620, 622, 624, 626, 628, 630.

Figure 6D:
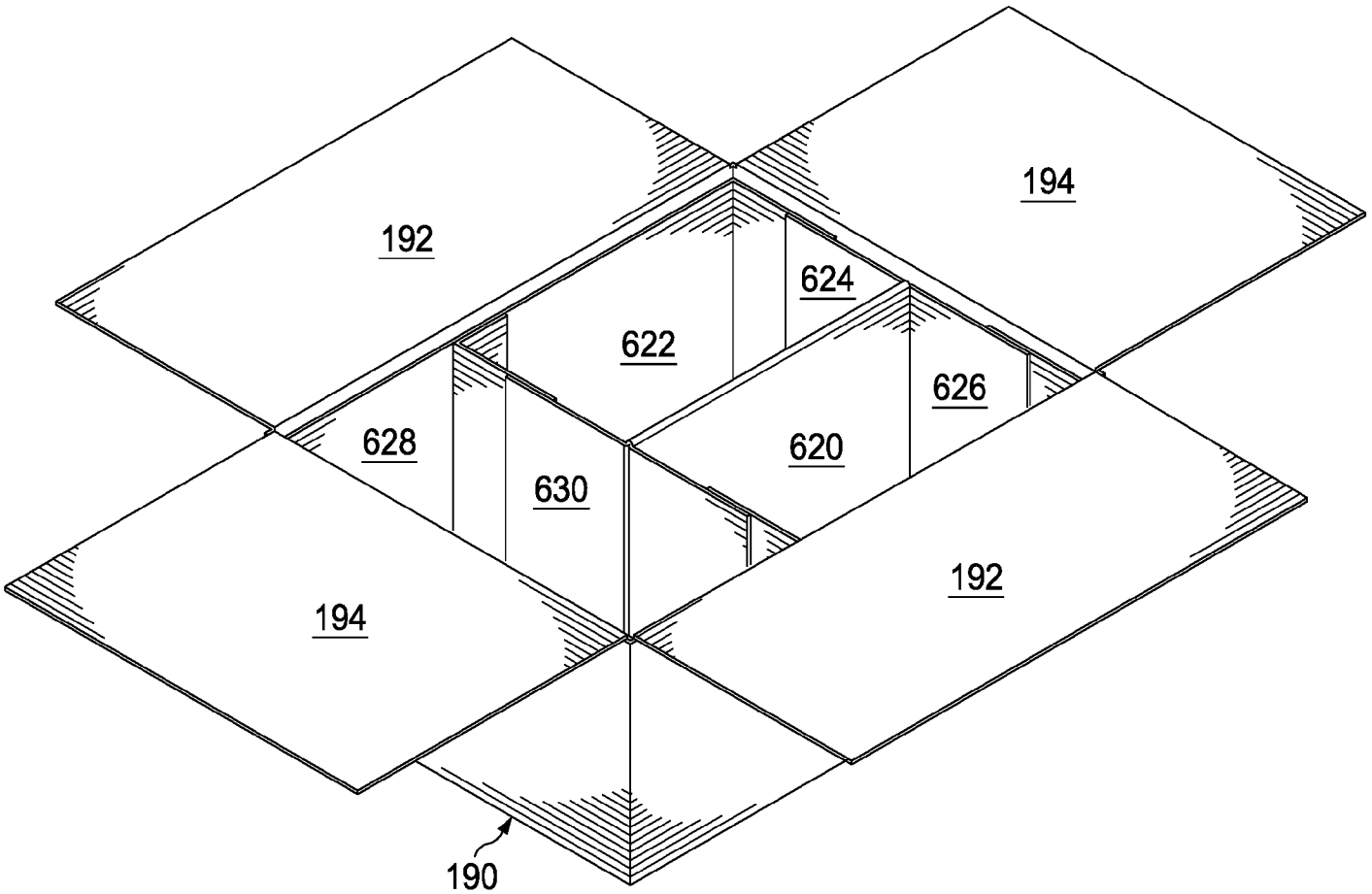

FIG. 6D illustrates this three cell embodiment when nested in corrugated box 190. Again shown is a corrugated box 190 with the flaps 192, 194 in an open position. The three cell embodiment of the vertical compartmented insert is shown nested in the corrugated box 190. Several interior panels 620, 622, 624, 626, 628, 630 can be seen.

A third embodiment of a vertical compartmented insert is illustrated in FIGS. 7A, 7B, 7C, and 7D. This third embodiment is a prefabricated two cell embodiment of the vertical compartmented insert.

Figure 7A:
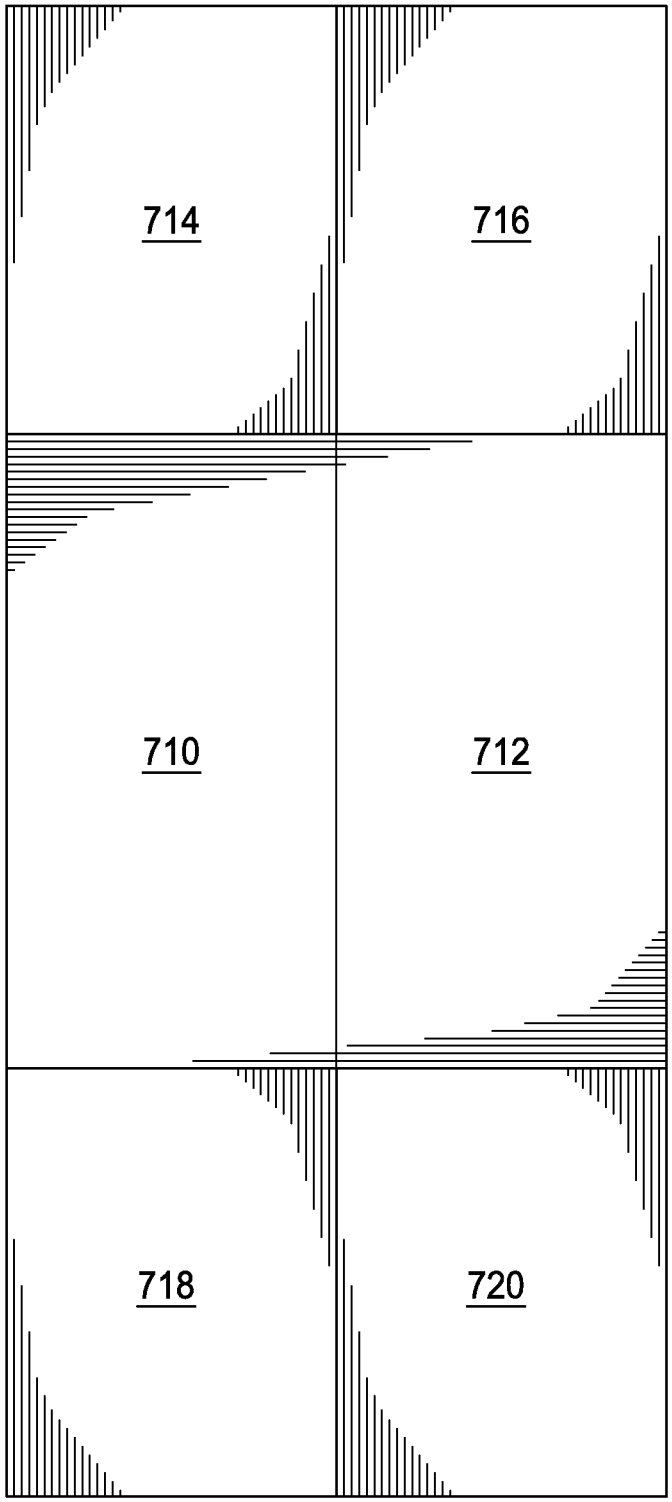
FIGS. 7A, 7B, 7C, and 7D illustrate a third embodiment of the packaging system of the present invention.
Figure 7B:
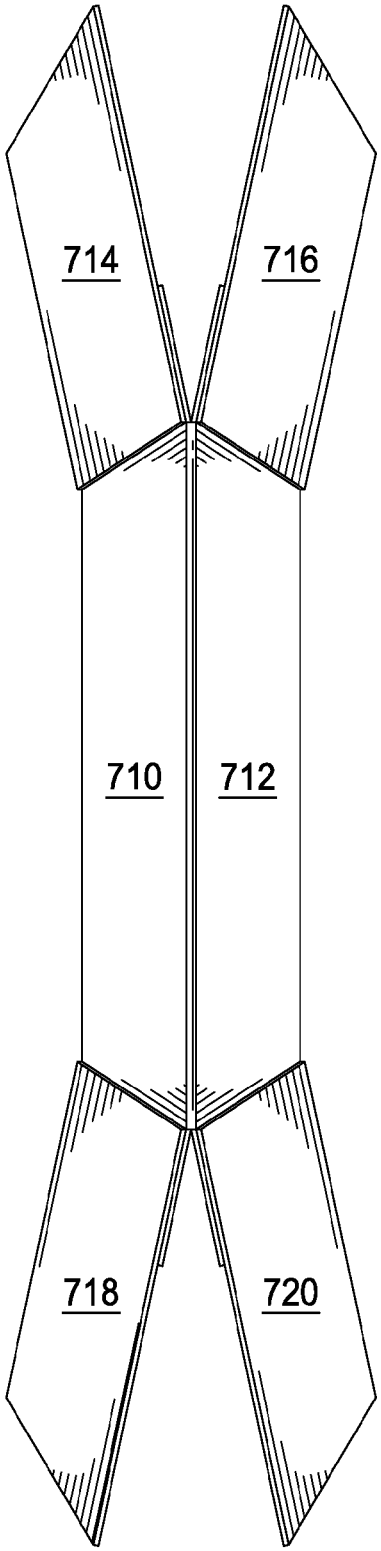

FIG. 7A shows this third embodiment in a flat position. Several panels 710, 712, 714, 716, 718, 720 are visible. FIG. 7B shows the beginning deployment of the two cell embodiment. Again shown are several panels 710, 712, 714, 716, 718, 720.

Figure 7C:
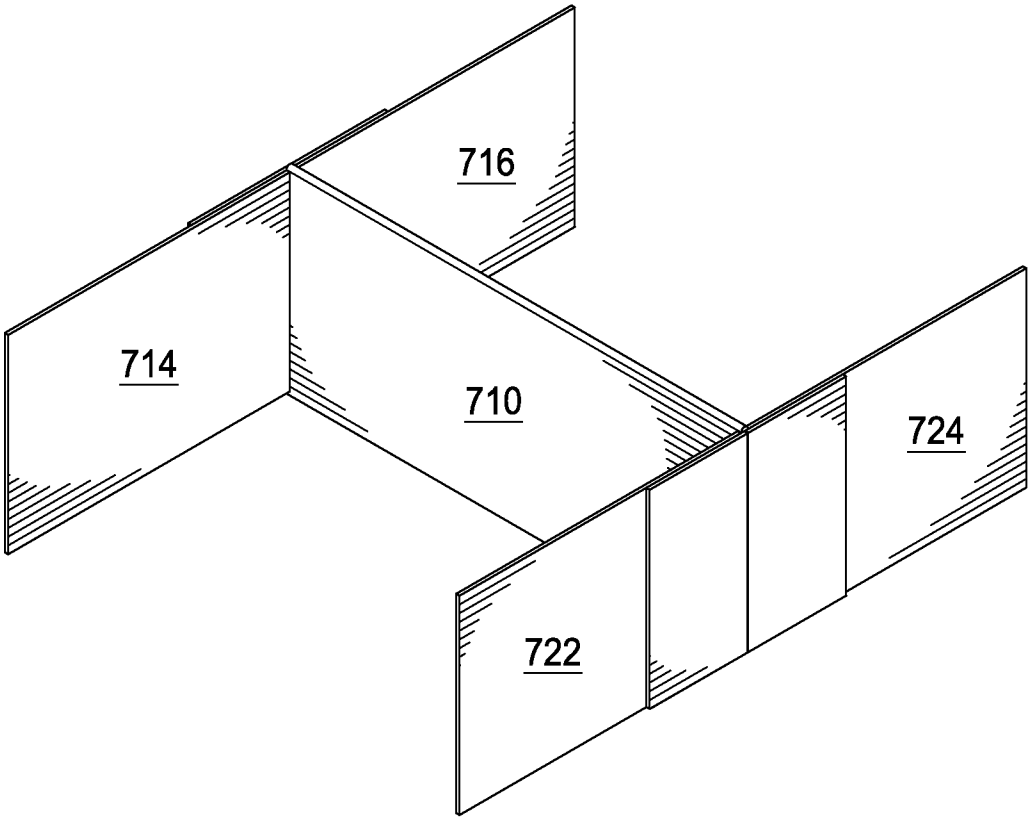

FIG. 7C shows the two cell embodiment of a vertical compartmented insert fully deployed. Now visible is a center divider comprising an interior panel 710. Also visible are two interior panels 714, 716 and two exterior panels 722, 724.

Figure 7D:
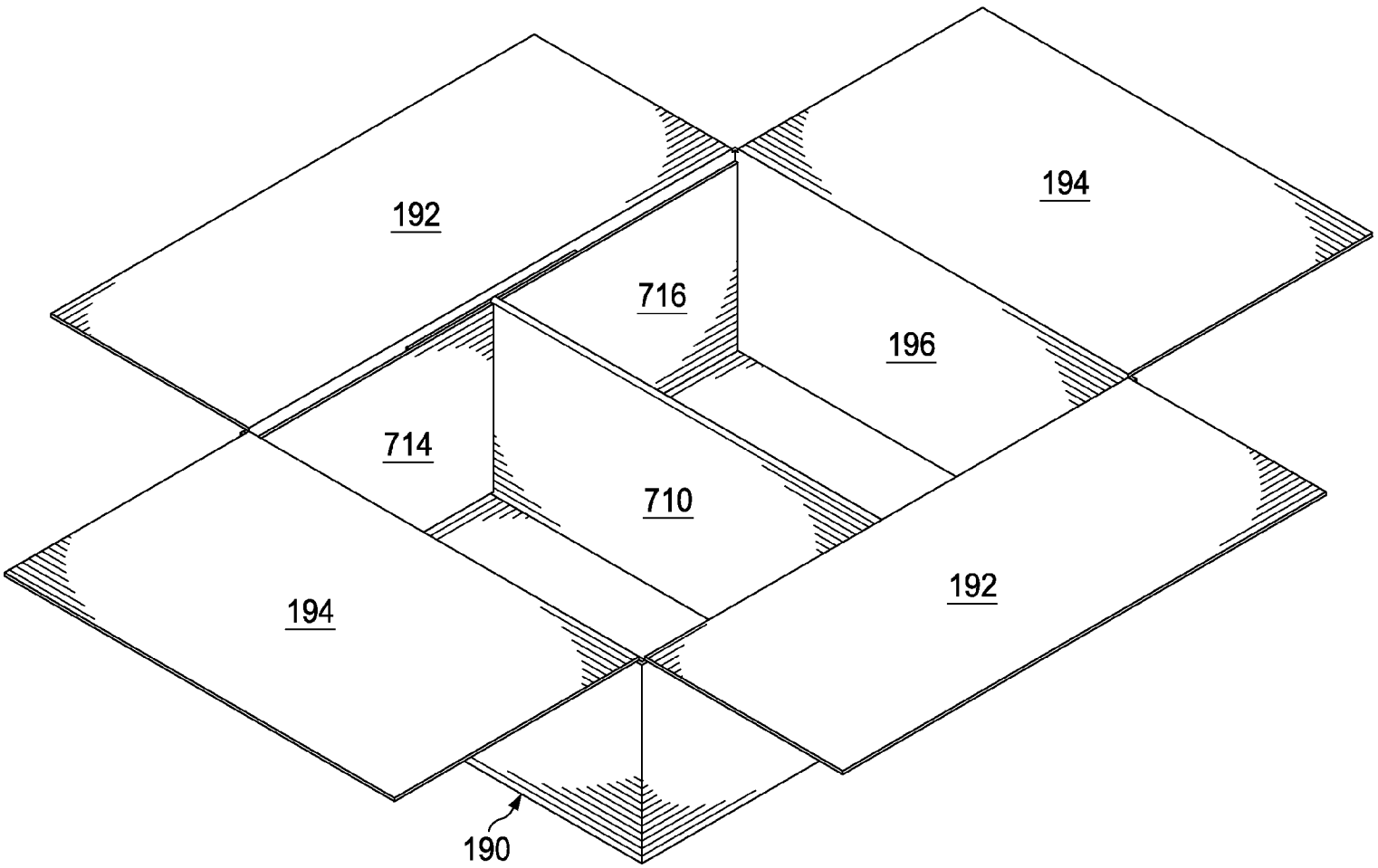

FIG. 7D shows the two cell embodiment nested in a corrugated box 190. Again, the corrugated box 190 is shown with the flaps 192, 194 in an open position. The two cell embodiment has been nesting within the corrugated box 190. Two interior panels 714, 716 of the two cell vertical compartmented insert can be seen. Another interior panel 710 which is a portion of the center divider is illustrated. Finally, an interior wall 196 of the corrugated cardboard box 190 can be seen.

The vertical compartmented inserts shown in FIGS. 6A, 6B, 6C, 6D, and shown in FIG. 7A, 7B, 7C, 7D can be combined with one of the vertical compartmented inserts illustrated for example in FIG. 2D as well as the horizontal insert 310 previously described above. Further, any combination of the three embodiments of the vertical compartmented inserts described herein can be used together in Applicants' packaging system.

Forgoing is merely illustrative of the principles of this invention, and various modifications can be made by those skilled in the art without departing from the scope and spirit of the invention. It should be understood, for example, that the packaging system components described herein can be modified in size and material to accomplish the same claimed functionality.

One embodiment of Applicants' invention, a shipping container, is defined by the following elements.

A shipping container comprising: a corrugated cardboard box; a first vertical support compartmented insert nested within said box, wherein said first vertical compartmented insert consists of a plurality of rectangular compartments and at least one detachable interior divider; horizontal insert placed on top of said first vertical compartmented insert, wherein said horizontal insert comprises a perforation pattern that aligns with the at least one interior divider of the first vertical compartmented insert; a second vertical compartmented insert nested within said box and on top of said horizontal insert, wherein said second vertical compartmented insert consists of a plurality of rectangular compartments and at least one detachable interior side walls.

The shipping container wherein all components consist of a corrugated cardboard material.

The shipping container wherein said first vertical compartmented insert comprise a primary interior divider consisting of a folded corrugated cardboard sheet and two secondary interior dividers, wherein further said second interior dividers are attached in a perpendicular arrangement to said primary interior divider; and optionally wherein both of said secondary interior dividers are detachable from said primary interior divider.

The shipping container wherein said horizontal insert further comprises a first score line along the width of the insert, wherein further the horizontal insert is foldable in half along said first score line; and optionally wherein said horizontal insert further comprises a second score line along the width of the insert, wherein further said second score line is parallel to said first score line, and wherein further the distance from said first score line to said second score line is equal to the height of the second vertical compartmented insert, and optionally wherein said perforation pattern of the horizontal insert consists of a perforation line that starts at said first score line and extends perpendicularly from said first score line to bisect said second score line.

The shipping container wherein said perforation pattern of the horizontal insert stops short of the end of the horizontal insert after bisecting said second score line.

The shipping container further comprising a vertical insert having a length equal to the diagonal distance from opposing corners of one of the rectangular compartments of a vertical compartmented insert.

One embodiment of Applicants' packaging system is described as follows.

A packaging system for the packaging of disparate items of varying shapes, sizes, and density, said system comprising the steps of:

a) constructing a corrugated box having an opening on top;
b) expanding a flat compartment insert to form a first vertical compartmented insert;
c) nesting the expanded first vertical compartmented insert inside the constructed corrugated box of step a);
d) customizing the first vertical compartmented insert for a first required load pattern by breaking away none to two compartment walls and folding any such walls back against an adjoining perpendicular wall;
e) loading the box with the nested first vertical compartmented insert of step b) according to a first required load pattern;
f) configuring a horizontal insert in accordance with the first required load pattern by folding back none to one portion of the horizontal insert;
g) placing the horizontal insert within the box and on top of the first vertical support compartmented insert in accordance with the first required load pattern;
h) expanding a flat compartment insert to form a second vertical compartmented insert;
i) customizing the second vertical compartmented insert for a first required load pattern and a second required load pattern by breaking away none to two compartment walls and folding any such walls back against an adjoining perpendicular wall;

j) nesting the expanded second vertical compartmented insert inside the constructed corrugated box of step a) and on top of the configured horizontal insert of step f);

k) loading the box with the nested second vertical compartmented insert of step j) according to a second required load pattern; and l) sealing said box.

The packaging system wherein the customizing step d) precedes the nesting step c).

The packaging system wherein a vertical diagonal insert is placed in a compartment of one of the vertical compartmented insert, thus dividing said compartment diagonally.

The packaging system wherein the horizontal insert is configured in step f) by folding said horizontal insert in two about a first score line to form a first half and a second half of said horizontal insert, and optionally wherein the placing of step g) comprises inserting the horizontal insert in the box with the first half of said horizontal insert in a horizontal position on top of the first vertical compartmented insert and the second half of said horizontal insert perpendicular to the first half and abutting an interior vertical wall of the box, and optionally wherein the nesting of step j) further comprises folding a portion of the second half of the horizontal insert over the top of the second vertical compartmented insert after the second vertical compartmented insert is nested in the box, said folding of a portion of the second half of the horizontal insert occurring along a second score line, wherein further said first score line and said second score line are parallel.

The packaging system wherein the configuring of step f) comprises folding back a quarter section of the horizontal insert by breaking away said quarter section from the reminder of the horizontal insert along a perforation line.

We claim:

1. A shipping container comprising:

a corrugated cardboard box;

a first vertical compartmented insert nested within said box, wherein said first vertical compartmented insert comprises a rectangular vertical array of interior dividing walls having upper wall ends and forming there between a plurality of rectangular compartments, each having a storage volume, a portion of at least one of the vertical interior dividing walls being detachable from a remainder of the wall;

a horizontal insert placed on top of and resting on the upper wall ends of said first vertical compartmented insert, wherein said horizontal insert comprises a perforation pattern that aligns with the at least one of the vertical interior dividing walls of the first vertical compartmented insert;

a second vertical compartmented insert nested within said box separated from the first compartmented insert by the horizontal insert and supported on top of said horizontal insert, wherein said second vertical compartmented insert comprises a rectangular vertical array of interior dividing walls forming there between a plurality of rectangular compartments, each having a storage volume, a portion of at least one of the vertical interior dividing walls being detachable;

wherein detachment of the portion of the least one detachable vertical interior wall of either of the first and second vertical compartmented inserts combines the storage volumes of two adjacent compartments that were previously separated by the detachable portion of the vertical interior wall, while the storage volumes of other compartments of the plurality of compartments are unchanged.

2. The shipping container of claim 1, wherein all components are comprised of corrugated cardboard material.

3. The shipping container of claim 1, wherein said horizontal insert further comprises a first score line parallel to two opposed sides of the insert, wherein further the horizontal insert is foldable along said first score line.

4. The shipping container of claim 3, wherein said horizontal insert further comprises a second score line along the width of the insert, wherein further said second score line is parallel to said first score line, and wherein further the distance from said first score line to said second score line is equal to the height of the second vertical compartmented insert.

5. The shipping container of claim 4, wherein said perforation pattern of the horizontal insert comprises a perforation line that starts at said first score line and extends at right angles to said first score line to intersect said second score line.

6. The shipping container of claim 5, wherein said perforation pattern of the horizontal insert extends beyond the intersection with said second score line to a termination point spaced away from an outer edge of the horizontal insert.

7. The shipping container of claim 3, wherein the horizontal insert is foldable in half along the first score line.

8. The shipping container of claim 1, further comprising a vertical insert having a length equal to a distance between diagonally opposed corners of one of the rectangular compartments of a vertical compartmented insert.

9. The shipping container of claim 1, wherein the first or the second vertical compartmented insert comprises first and second symmetrical portion about a folded wall having a first face facing toward the first portion, and a second face facing toward the second portion.

10. The shipping container of claim 1, wherein the horizontal insert includes finger grips.

11. A shipping container comprising:

a corrugated cardboard box;

a first vertical compartmented insert nested within said box, wherein said first vertical compartmented insert comprises a rectangular vertical array of interior dividing walls having upper wall ends and forming there between a plurality of rectangular compartments, each having a storage volume, a portion of at least one of the vertical interior dividing walls being detachable from a remainder of the wall, the first vertical array having first and second symmetrical portions about a folded wall having a first face facing toward the first portion, and a second face facing toward the second portion;

a second vertical compartmented insert nested within said box, wherein said second vertical compartmented insert comprises a rectangular vertical array of interior dividing walls forming there between a plurality of rectangular compartments, each having a storage volume, a portion of at least one of the vertical interior dividing walls being detachable a horizontal insert inserted between the first and second compartmented inserts and resting on top of the upper wall ends to thereby separate the first vertical compartmented insert from the second vertical compartmented insert, the horizontal insert comprising a perforation pattern that aligns with the at least one of the vertical interior dividing walls of a vertical compartmented insert located beneath, selected from the first and second vertical compartments;

wherein the detachment of the portion of the least one detachable vertical interior wall of either of the first and second vertical compartmented inserts combines the storage volumes of adjacent compartments that were previously separated by the detachable vertical interior wall, while the storage volumes of other compartments of the plurality of compartments are unchanged.

12. The shipping container of claim 11, wherein the second vertical compartmented insert comprises first and second symmetrical portion about a folded wall having a first face facing toward the first portion, and a second face facing toward the second portion.

13. The shipping container of claim 11, wherein said horizontal insert comprises a first score line parallel to two opposed sides of the insert, and wherein the horizontal insert is foldable along said first score line.

14. The shipping container of claim 13, wherein:

said horizontal insert further comprises a second score line along the width of the insert, said second score line is parallel to said first score line, a distance from said first score line to said second score line is equal to a height of the second vertical compartmented insert, and said perforation pattern of the horizontal insert extends beyond the intersection with said second score line to a termination point spaced away from an outer edge of the horizontal insert.

* * * * *